US008439756B2

(12) United States Patent
Baerlocher et al.

(10) Patent No.: US 8,439,756 B2
(45) Date of Patent: May 14, 2013

(54) GAMING SYSTEM HAVING A DISPLAY/INPUT DEVICE CONFIGURED TO INTERACTIVELY OPERATE WITH EXTERNAL DEVICE

(75) Inventors: Anthony J. Baerlocher, Reno, NV (US); Kimberly M. Campbell, Reno, NV (US); Christiaan R. Champagne, Las Vegas, NV (US); Dwayne A. Davis, Reno, NV (US); Hans Elias, Reno, NV (US); Damien C. Ennis, Reno, NV (US); Michael P. Khamis, Reno, NV (US); David N. Myers, Reno, NV (US); David M. Palmer, Reno, NV (US)

(73) Assignee: IGT, Reno, NV (US)

( * ) Notice: Subject to any disclaimer, the term of this patent is extended or adjusted under 35 U.S.C. 154(b) by 854 days.

(21) Appl. No.: 12/267,120

(22) Filed: Nov. 7, 2008

(65) Prior Publication Data

US 2009/0197676 A1 Aug. 6, 2009

Related U.S. Application Data

(60) Provisional application No. 60/986,844, filed on Nov. 9, 2007.

(51) Int. Cl.
*A63F 9/24* (2006.01)

(52) U.S. Cl.
USPC ..... 463/37; 463/31; 463/16

(58) Field of Classification Search ..... 463/37
See application file for complete search history.

(56) References Cited

U.S. PATENT DOCUMENTS

| | | | |
|---|---|---|---|
| 4,861,041 | A | 8/1989 | Jones et al. |
| 4,906,005 | A | 3/1990 | Manabe |
| 5,102,135 | A | 4/1992 | Addiechi |
| 5,636,838 | A | 6/1997 | Caro |
| 5,755,440 | A | 5/1998 | Sher |
| 5,839,955 | A | 11/1998 | Mangano et al. |
| 6,039,648 | A | 3/2000 | Guinn et al. |

(Continued)

FOREIGN PATENT DOCUMENTS

| | | |
|---|---|---|
| EP | 0956111 | 11/1999 |
| EP | 1226851 | 7/2002 |

(Continued)

OTHER PUBLICATIONS

Plinko description of Price is Right game from 1983, at http://gscentral.net/plinko.htm.

(Continued)

*Primary Examiner* — Dmitry Suhol
*Assistant Examiner* — Carl V Larsen
(74) *Attorney, Agent, or Firm* — Neal, Gerber & Eisenberg LLP

(57) ABSTRACT

A game table having a multiplayer interactive display/input device which enables multiple players to play primary or base wagering games and/or secondary or bonus games using the display/input device. The display/input device enables multiple players to simultaneously interact with the game table and the various games using the same display/input device. In various embodiments, the game table operates with one or more separate physical input devices, each having one or a plurality of the encoded patterns and each being sized and configured to be placed on top of the game table. The separate physical input devices enable the player to interact with the display/input device.

63 Claims, 11 Drawing Sheets

U.S. PATENT DOCUMENTS 6,053,823 A 4/2000 Mathews
6,059,658 A 5/2000 Mangano et al.
6,082,887 A 7/2000 Feuer et al.
6,135,884 A 10/2000 Hedrick et al.
6,152,448 A 11/2000 Cudlipp
6,209,869 B1 4/2001 Mathews
6,217,022 B1 4/2001 Astaneha
6,309,299 B1 10/2001 Weiss
6,312,334 B1 11/2001 Yoseloff
6,497,409 B2 12/2002 Mathews
6,498,590 B1 12/2002 Dietz et al.
6,533,662 B2 3/2003 Soltys et al.
6,659,462 B1 12/2003 Scott
6,666,766 B2 12/2003 Baerlocher et al.
6,705,944 B2 3/2004 Luciano
6,726,563 B1 4/2004 Baerlocher et al.
6,726,565 B2 4/2004 Hughs-Baird
6,733,390 B2 5/2004 Walker et al.
6,869,359 B1 3/2005 Mathews
6,890,255 B2 5/2005 Jarvis et al.
6,921,333 B2 7/2005 Taguchi
6,988,731 B2 1/2006 Inoue
7,012,595 B2 3/2006 Lu
7,029,395 B1 4/2006 Baerlocher
7,030,861 B1 4/2006 Westerman et al.
7,094,150 B2 8/2006 Ungaro et al.
7,169,044 B2 1/2007 Baerlocher et al.
7,204,428 B2 4/2007 Wilson
7,223,172 B2 5/2007 Baerlocher et al.
7,226,357 B2 6/2007 Vancura et al.
7,306,520 B2 12/2007 Kaminkow et al.
7,329,179 B2 2/2008 Baerlocher
7,331,868 B2 2/2008 Beaulieu et al.
7,351,146 B2 4/2008 Kaminkow
7,374,486 B2 5/2008 Baerlocher
7,397,464 B1 * 7/2008 Robbins et al. ..... 345/173
7,419,162 B2 9/2008 Lancaster et al.
7,463,270 B2 12/2008 Vale et al.
7,465,227 B2 12/2008 Baerlocher
7,470,185 B2 12/2008 Baerlocher
7,479,949 B2 1/2009 Jobs et al.
7,488,251 B2 2/2009 Kaminkow
2001/0000118 A1 * 4/2001 Sines et al. ..... 273/274
2002/0077167 A1 6/2002 Merari
2002/0077170 A1 6/2002 Johnson et al.
2002/0119824 A1 8/2002 Allen
2002/0140680 A1 10/2002 Lu
2002/0169017 A1 11/2002 Visoenik
2002/0185981 A1 12/2002 Dietz et al.
2003/0004871 A1 1/2003 Rowe
2003/0020733 A1 1/2003 Yin
2003/0094752 A1 5/2003 Mathews
2003/0144053 A1 7/2003 Michaelson
2004/0053661 A1 3/2004 Jones et al.
2004/0063492 A1 4/2004 Baerlocher et al.
2004/0127284 A1 7/2004 Walker et al.
2004/0171416 A1 9/2004 Baerlocher et al.
2004/0204218 A1 10/2004 Hughs-Baird
2005/0009600 A1 1/2005 Rowe et al.
2005/0032568 A1 2/2005 Griswold et al.
2005/0054429 A1 3/2005 Baerlocher et al.
2005/0060050 A1 3/2005 Baerlocher
2005/0119043 A1 6/2005 Berman et al.
2005/0162402 A1 7/2005 Watanachote
2005/0164759 A1 7/2005 Smith et al.
2005/0178074 A1 8/2005 Kerosetz
2005/0215307 A1 9/2005 Jarvis et al.
2005/0245302 A1 * 11/2005 Bathiche et al. ..... 463/1
2005/0251800 A1 * 11/2005 Kurlander et al. ..... 717/174
2005/0282625 A1 12/2005 Nicely
2005/0282626 A1 12/2005 Manfredi et al.
2006/0022956 A1 2/2006 Lengeling et al.
2006/0026521 A1 2/2006 Hotelling et al.
2006/0030394 A1 2/2006 Crivelli et al.
2006/0030959 A1 2/2006 Duhamel
2006/0030960 A1 2/2006 Duhamel et al.
2006/0032680 A1 2/2006 Elias et al.
2006/0046821 A1 3/2006 Kaminkow et al.
2006/0046849 A1 3/2006 Kovacs et al.
2006/0052885 A1 3/2006 Kong
2006/0058088 A1 3/2006 Crawford, III et al.
2006/0066564 A1 3/2006 Yee et al.
2006/0068864 A1 3/2006 White et al.
2006/0068870 A1 3/2006 Crawford, III et al.
2006/0086896 A1 4/2006 Han
2006/0097991 A1 5/2006 Hotelling et al.
2006/0125803 A1 6/2006 Westerman et al.
2006/0128457 A1 6/2006 Cannon
2006/0135238 A1 6/2006 Lancaster et al.
2006/0148565 A1 7/2006 Gauselmann et al.
2006/0157928 A1 7/2006 O'Halloran
2006/0170154 A1 8/2006 Matsuno et al.
2006/0170155 A1 8/2006 Silverman
2006/0197750 A1 9/2006 Kerr et al.
2006/0197753 A1 9/2006 Hotelling
2006/0237905 A1 10/2006 Nicely et al.
2006/0238517 A1 10/2006 King et al.
2006/0238518 A1 10/2006 Westerman et al.
2006/0238519 A1 10/2006 Westerman et al.
2006/0238520 A1 10/2006 Westerman et al.
2006/0238521 A1 10/2006 Westerman et al.
2006/0238522 A1 10/2006 Westerman et al.
2006/0240887 A1 10/2006 Walker et al.
2006/0249899 A1 11/2006 Lease
2006/0284874 A1 12/2006 Wilson
2006/0287053 A1 12/2006 Yokota
2007/0054726 A1 3/2007 Muir et al.
2007/0069459 A1 3/2007 Guindulain Vidondo
2007/0070050 A1 3/2007 Westerman et al.
2007/0070051 A1 3/2007 Westerman et al.
2007/0070052 A1 3/2007 Westerman et al.
2007/0075488 A1 4/2007 Pececnik
2007/0078919 A1 4/2007 Westerman et al.
2007/0081726 A1 4/2007 Westerman et al.
2007/0120320 A1 5/2007 Miltenberger et al.
2007/0135203 A1 6/2007 Nicely
2007/0135204 A1 6/2007 Nicely
2007/0139395 A1 6/2007 Westerman et al.
2007/0146336 A1 6/2007 Ording et al.
2007/0152980 A1 7/2007 Kociendae et al.
2007/0152984 A1 7/2007 Ording et al.
2007/0155464 A1 7/2007 Baerlocher
2007/0155481 A1 7/2007 Vancura et al.
2007/0157089 A1 7/2007 Van Os et al.
2007/0177803 A1 8/2007 Elias et al.
2007/0177804 A1 8/2007 Elias et al.
2007/0188444 A1 8/2007 Vale et al.
2007/0192550 A1 8/2007 Rodeheffer et al.
2007/0213119 A1 9/2007 Baerlocher et al.
2008/0020815 A1 1/2008 Lancaster et al.
2008/0070674 A1 3/2008 Lancaster et al.
2008/0076500 A1 3/2008 Lancaster et al.
2008/0076581 A1 3/2008 Mattice et al.
2008/0102934 A1 5/2008 Tan
2008/0108406 A1 5/2008 Oberberger
2008/0108425 A1 5/2008 Oberberger
2008/0113759 A1 5/2008 Baerlocher
2008/0122803 A1 * 5/2008 Izadi et al. ..... 345/175
2008/0132320 A1 6/2008 Rodgers
2008/0182650 A1 7/2008 Randall et al.
2008/0182655 A1 7/2008 DeWaal et al.
2008/0194316 A1 8/2008 Baerlocher
2008/0214280 A1 9/2008 Baerlocher
2008/0318668 A1 12/2008 Ching et al.
2009/0117994 A1 5/2009 Kelly et al.
2009/0118005 A1 * 5/2009 Kelly et al. ..... 463/31
2009/0124379 A1 5/2009 Wells
2009/0124383 A1 5/2009 Gadda et al.
2009/0143141 A1 6/2009 Wells et al.
2009/0325686 A1 12/2009 Davis et al.
2010/0087241 A1 4/2010 Nguyen et al.
2010/0130280 A1 * 5/2010 Arezina et al. ..... 463/20
2011/0065513 A1 3/2011 Nordahl et al.

FOREIGN PATENT DOCUMENTS

EP 1671684 6/2006
EP 1710000 10/2006

| | | | |
|---|---|---|---|
| EP | 1721642 | | 11/2006 |
| EP | 1736215 | | 12/2006 |
| EP | 1769828 | | 4/2007 |
| GB | 2358591 | | 8/2001 |
| GB | 2395139 | | 5/2004 |
| GB | 2431362 | | 4/2007 |
| JP | 2005-211384 | A | 8/2005 |
| WO | WO 97/38766 | | 10/1997 |
| WO | WO 00/33269 | | 6/2000 |
| WO | WO 03/025867 | | 3/2003 |
| WO | WO 2006/015442 | | 2/2006 |
| WO | WO 2006/041765 | | 4/2006 |
| WO | WO 2006/061616 | | 6/2006 |
| WO | WO 2006/078219 | | 7/2006 |
| WO | WO 2006/094398 | | 9/2006 |
| WO | WO 2006/097007 | | 9/2006 |
| WO | WO 2007/024202 | | 3/2007 |
| WO | WO 2007/033430 | | 3/2007 |
| WO | WO 2007/077449 | | 7/2007 |
| WO | WO 2008/045464 | | 4/2008 |

OTHER PUBLICATIONS

A Day on the Surface: A Hands-On Look at Microsoft's New Computing Platform article printed from http://arstechnica.com/microsoft/news/2007/09/surface.ars/2 on Jan. 27, 2009.
The Price is Right Video Slots advertisement Featuring Plinko published by IGT.
Multi-touch, Surface Computing, iPhone, and more . . . article printed from Just Good Design on Nov. 6, 2008.
Multitouch Interface Is Starting to Spread Among New Devices article printed in The Wall Street Journal on Jan. 31, 2008.
The Coffee Table that will Change the World, article printed in Popular Mechanics Magazine in Jul. 2007.
The Shape of Computers to Come article published in Wall Street Journal on May 30, 2007.
Letter from Marvin A. Motsenbocker of Mots Law dated Nov. 29, 2011 regarding Third Party Submission in Published Application Under 37 C.F.R. 1.99 filed for U.S. Appl. No. 13/152,786 (1 page).
Third Party Submission in Published Application Under 37 C.F.R. 1.99 filed for U.S. Appl. No. 13/152,786, dated Nov. 29, 2011 (3 pages).
Partially highlighted U.S. Patent No. 6,921,333 submitted with Third Party Submission in Published Application Under 37 C.F.R. 1.99 for U.S. Appl. No. 13/152,786 (2 pages).
Partially highlighted JP 2005-211384A and English translation of paragraph [0022] of same submitted with Third Party Submission in Published Application Under 37 C.F.R. 1.99 for U.S. Appl. No. 13/152,786 (3 pages).
Office Action for U.S. Appl. No. 13/152,786 dated Feb. 2, 2012 (9 pages).
Office Action for U.S. Appl. No. 13/152,796 dated Feb. 2, 2012 (6 pages).
Office Action issued for U.S. Appl. No. 13/152,814 dated Dec. 12, 2011.
U.S. Appl. No. 11/557,843, filed Nov. 8, 2006, Baerlocher.
U.S. Appl. No. 11/853,952, filed Sep. 28, 2007, Gerrard, et al.
U.S. Appl. No. 11/864,439, filed Sep. 28, 2007, Oberberger et al.
U.S. Appl. No. 11/873,948, filed Oct. 17, 2007, Zielinski.
U.S. Appl. No. 11/924,396, filed Oct. 25, 2007, Iddings.
U.S. Appl. No. 12/102,308, filed Apr. 14, 2008, Baerlocher.

* cited by examiner

GAMING SYSTEM HAVING A DISPLAY/INPUT DEVICE CONFIGURED TO INTERACTIVELY OPERATE WITH EXTERNAL DEVICE

PRIORITY

This application is a non-provisional of, claims the benefit of and priority to U.S. Provisional Application No. 60/986,844, filed Nov. 9, 2007, the entire contents of which is incorporated herein by reference.

CROSS REFERENCE TO RELATED APPLICATIONS

This application is related to the following co-pending commonly-owned U.S. patent applications: "GAMING SYSTEM HAVING USER INTERFACE WITH UPLOADING AND DOWNLOADING CAPABILITY," application Ser. No. 12/267,207; "GAMING SYSTEM HAVING MULTIPLE PLAYER SIMULTANEOUS DISPLAY/INPUT DEVICE," application Ser. No. 13/152,786; "GAMING SYSTEM HAVING MULTIPLE PLAYER SIMULTANEOUS DISPLAY/INPUT DEVICE," application Ser. No. 13/152,796; and "GAMING SYSTEM HAVING MULTIPLE PLAYER SIMULTANEOUS DISPLAY/INPUT DEVICE," application Ser. No. 13/152,814.

BACKGROUND

Known proposed wagering game tables are not able to create a sufficiently real life table gaming experience in which multiple players playing a same gaming area and share game play and other experiences. While proposed wagering game tables offer certain advantages in terms of game flexibility and heightened graphics, proposed game tables separate the players from one another using individual gaming devices or individual display screens (with separate touch screens or other input devices) for each player. One primary reason for this is that these separate player stations enable each of the players to make inputs (using their own separate touch screen or other input devices) at the same time or at nearly the same time. While certain game tables using so-called multi-touch systems have been proposed, these game tables do not fully provide a real life table gaming experience for multiple players.

Accordingly, a need exists for improved gaming systems that enables multiple players to simultaneously play shared integrated games more interactively and which provides a more real life table gaming experience.

SUMMARY

Various embodiments of the gaming system of the present disclosure provide a game table having a multiplayer interactive display/input device which enables multiple players to simultaneously play primary or base wagering games and/or secondary or bonus games. The display/input device enables multiple players to simultaneously interact with the gaming system, the game table and the various games using a common or the same display/input device. For example, the game table enables multiple players to manipulate displayed objects (such as cards or other game symbols) displayed by the display/input device at the same time. That is, the display/input device of the game table is configured to accept multiple inputs (such as touch inputs) from multiple players simultaneously. This enables the display/input device to simultaneously display the same game to multiple players in an integrated seamless manner without the need for multiple different sets of display devices and input devices for each player as in numerous previously proposed game tables.

The display/input device in various embodiments is additionally configured to sense actions or movements made close to the surface of the display/input device. Thus, for example, in certain embodiments, the display/input device can discern between (a) the waving of a players hand back and forth relative to the display/input device as one type of input by the player, and (b) a vertical movement of the player's hand up and down relative to the display/input device as a different type of input by the player. In various embodiments, the display/input device is configured to do this for multiple players at the same time. Thus, in the preferred embodiment, the game table has a single multiplayer display/input device which all of the players use to play the game(s).

Additionally, in various embodiments, the display/input device of the game table is configured to interact with one or more external objects such as external physical input devices (besides a player's hand) as described below.

These abilities to display multiple game functions and game symbols to multiple players at the same time on one display/input device, to receive multiple inputs from multiple players at the same time through the one display/input device, and to interact with external objects provides for seamless integrated game play much more like a live game table while providing the security and other advantages of an automated gaming system. This also provides for additional game play functionality and additional player interaction functionality as further discussed below in accordance with the present invention.

More specifically, one suitable table for the gaming system of the present disclosure is provided by Microsoft Corporation, Redmond, Wash., which uses a technology described in at least U.S. Pat. No. 7,204,428, the entire contents of which are incorporated herein by reference. This table is configured to simultaneously sense touches of multiple people and is also configured to sense coded patterns such as coded patterns applied to objects above the display/input surface of the table. This table is configured to identify the inputs by people and the objects when placed on the surface of the display/input device. This table is also configured to sense movements within a predefined distance above the table. In various embodiments, the game table of the present disclosure includes a plurality of infrared ("IR") video cameras on an opposite side of the display surface from the person or object. In various embodiments, one or more of the cameras are configured to detect reflected infrared ("IR") light received from or reflected by the person or the coded pattern printed on or attached to the object. In various embodiments, the coded pattern is an identifier of the object as further discussed below. It should be appreciated that, as further described below, the coded pattern is passive in that the coded pattern does not send any electronic signal to the game table, but is rather identified by the game table.

The present disclosure contemplates using such game tables for displaying game symbols (such as cards, dice, etc.) and displaying game functions (such as bets required, outcomes and awards) to one or more players and for enabling one or more players and/or live dealers to simultaneously and/or sequentially interact with the game tables using their hands, or using other physical objects (such as playing cards, dice, or wagering chips) or other suitable input devices.

In one example embodiment, the one display/input device display virtual cards for and the virtual chips of each of a plurality of players. The cameras operate with the displayed cards and displayed chips to sense when the displayed cards and the displayed chips are touched or moved by a player or dealer to accomplish a function in or related to a game. The processing and memory controlling the game table are configured for this purpose. For example, the processing and memory are configured to enable a card to be touched by a live dealer, who slides the displayed card from a position in front of the dealer to a position in front of the player such that it can be thereafter handled (such as moved or otherwise manipulated according to game rules) by the player. The processing and memory thereafter enable the player to manipulate the card in accordance with the game rules. Alternatively, the processing and memory are configured to provide a virtual dealer who deals the cards to the players. This facilitates game play in an integrated seamless manner between the dealer and all of the players in part because the cards and chips are seamlessly shown or displayed moving between the dealer and players without any interruption similar to a live game table.

In an example blackjack game embodiment, players take turns as the live dealer or virtual dealer moves across the game table. In one embodiment, the gaming system is programmed to move from player to player, making the current indicated player the active player and ignoring or disallowing certain or all actions taken by other players. Thus, a player who is not active at a point in time can try to make an input such as a "hit" or "stay" movement without actually inputting a decision (what causes an action) into the gaming system. In other words, at adequate times, the gaming system only recognizes inputs by one designated player and can ignore inputs by the other players. The display/input device in one embodiment indicates or highlights the active player (such as by brightening or enlarging that active player's cards, while dulling non-active cards). This indicating or highlighting lets each player playing at the game table know which player is the currently active player (i.e., the player whose turn it is), which player has just made a gaming decision, and which player is up next. This example embodiment shows how the game table enables the players to take turns making inputs through the same display/input device. It should be appreciated that the game table can also be configured to alternatively enable the two or more of the players to make such inputs simultaneously, and that a better gaming experience is provided with a single display/input device that displays all of the desired game functional elements to the players and enables the players to make such inputs through the same display/input device. Other example primary games including video poker and group poker are discussed herein.

In one video poker embodiment, the game table operates with one or more separate physical input devices and which do not have an electronic processor, receiver or transmitter, each having one or a plurality of the encoded patterns and each being sized and configured to be placed on top of the game table (i.e., on top of the display/input device) and which do not have an electronic processor, receiver or transmitter. For example, the player places one separate physical input device on the game table to play a video poker game. A first encoding or tag on the physical input device identifies the physical input device as the video poker device and locates the physical input device on the game table. The separate physical input device can for example signal the start of the video poker game. Alternatively, the poker game starts and prompts the player to place the device on the game table at a desired location. This enables the player to place the separate physical input device at a desirable, comfortable position for the player. The tags employed with the game table can be any suitable tags such as radio frequency tags, barcode tags, or dot coded tags.

In one embodiment, the game table builds or displays the video poker game next to and in alignment with the separate physical input device. As stated above, the first encoding or tag is an input device identifier. In one embodiment, the separate physical input device has, for example, five additional encodings or tags, one for each of five cards dealt to the player. Each tag in one example embodiment is located on the bottom of a suitable spring loaded button. When the player presses one of the buttons (e.g., to select to keep a card), the display/input device senses its associated tag and keeps its associated card. Each of the five card encodings or tags is different in one embodiment, such that each tag is associated with a unique position of the separate physical input device.

Alternatively, each of the five card encodings or tags is the same, and the processors of the gaming system determine a distance from each of the five card tags to the home or identification tag. When the player presses one of the buttons of the separate physical input device, the display/input device senses the encoding or tag, the gaming system determines the distance from the card tag to the identifier tag to determine which of the buttons has been pressed, and keeps the tag's associated card. This separate physical input device thus enables a player to play a card game such as video poker at the game table while providing a separate physical mechanical input device which certain players like to use when playing such games.

It should also be appreciated that any suitable primary wagering games can be played in combination with a suitable secondary or bonus game displayed by the game table and that one or more separate physical mechanical input devices can be employed to play part or all of said primary or secondary games. In one bonus game example, the player is provided with a physical input device that is separate from the interactive game table. The physical input device interacts wirelessly with the game table, like above, here via a pair of encodings or tags. The first tag serves as an identifier and device locator like above. The second tag serves to determine a game state, here, whether the player has selected an award or not. The display/input device displays a number of bonus options from which the player can choose to reveal one or more awards. The player places the physical input device on the display/input device. The identifier tag tells the game table that the player has chosen the particular option. When the player is ready, the player presses a button or plunger of the separate physical input device, which moves the state tag within range of the game table's cameras, informing the game table that the player has made an input to have the selected option revealed.

In one example implementation, the bonus game is a selection game that has a gold prospector theme, in which the player presses a mechanical plunger of a separate physical input device to blast away charged rocks to reveal an award or outcome. In real life, such a plunger type device would need to be positioned far away from the blast for safety. In one embodiment, the game table accordingly enables the player to pull the plunger off of the selected and charged rock pile displayed by the game table. In one embodiment, the game table tracks the path from the rock pile to the plunger's final position and draws an electrical chord over the path from the rock pile to the chord to further the theme and enhance players excitement and enjoyment.

In another bonus type game using the game table, a separate physical input device includes a single tag and a series of enclosed chambers adjacent the tag. Each chamber has a door. The single tag identifies the device and tells the game table where the separate physical input device is positioned. The gaming system knows the spacing of each chamber from the single tag. Thus, the presence of the tag enables the game table to place and display prizes or other indicia underneath each of the chambers. In one embodiment, the interior side of the doors are each reflective or each have a reflective material. Accordingly, when each door is opened, the display/input device detects that the reflection is no longer present and thus senses that the door is opened. It should be appreciated that the players need to, in one embodiment, look through the chamber to see the displayed award. The display/input device displays awards based on which door is opened. In an alternative embodiment, the doors each have tags which enable the display/input device to detect when each door is open.

In one embodiment, the separate physical input device is used in a serial manner involving multiple players. One player chooses one door then slides the input device to another player with the selected door opened and the associated outcome revealed. The game table causes the prizes or outcomes beneath the separate physical input device to follow the device so that they remain hidden. The gaming system enables players to play a scratch-type game in which players have to pick bonus outcomes in a row out of a total number of total outcomes to receive a prize. Alternatively, each pick can reveal a separate prize that is distributed to the players in some fashion. The same separate physical input device and game strategies can be used alternatively with a single player. It should be appreciated that multiple separate physical input devices may be employed simultaneously or sequentially by multiple players.

It is therefore an advantage of the gaming device of the present disclosure to provide a gaming system having a display/input device that provides a game having game functional images that interact with a separate physical object or input device.

Another advantage of the present disclosure is to provide a gaming system having a display/input device and programmed to provide a game that accepts different inputs from a separate physical object or input device such as one input for separate identifying the input device and one or more other inputs for determining the state of the separate input device (such as plunger up or plunger down).

Another advantage of the present disclosure is to provide a gaming system having a display/input device and programmed to operate wirelessly with a physical object.

Another advantage of the present disclosure is to provide a gaming system having a game table configured to enable multiple players to operate a separate physical input device to communicate with the game table.

Another advantage of the present disclosure is to provide a gaming system having a game table configured to enable a separate physical input device to be sequentially used by multiple players to display game results.

Another advantage of the present disclosure is to provide a gaming system having a game table configured to enable a separate physical input device to be sequentially used by multiple players to display game results.

Another advantage of the present disclosure is to provide a gaming system having a game table configured to enable a separate physical input device to be sequentially used by multiple players and which enables players to see other players game results.

Another advantage of the present disclosure is to provide a gaming system which interacts with a separate physical mechanical input device that does not have an electronic processor, receiver, or transmitter.

Additional features and advantages are described herein, and will be apparent from, the following Detailed Description and the figures.

DETAILED DESCRIPTION

Figure 1:
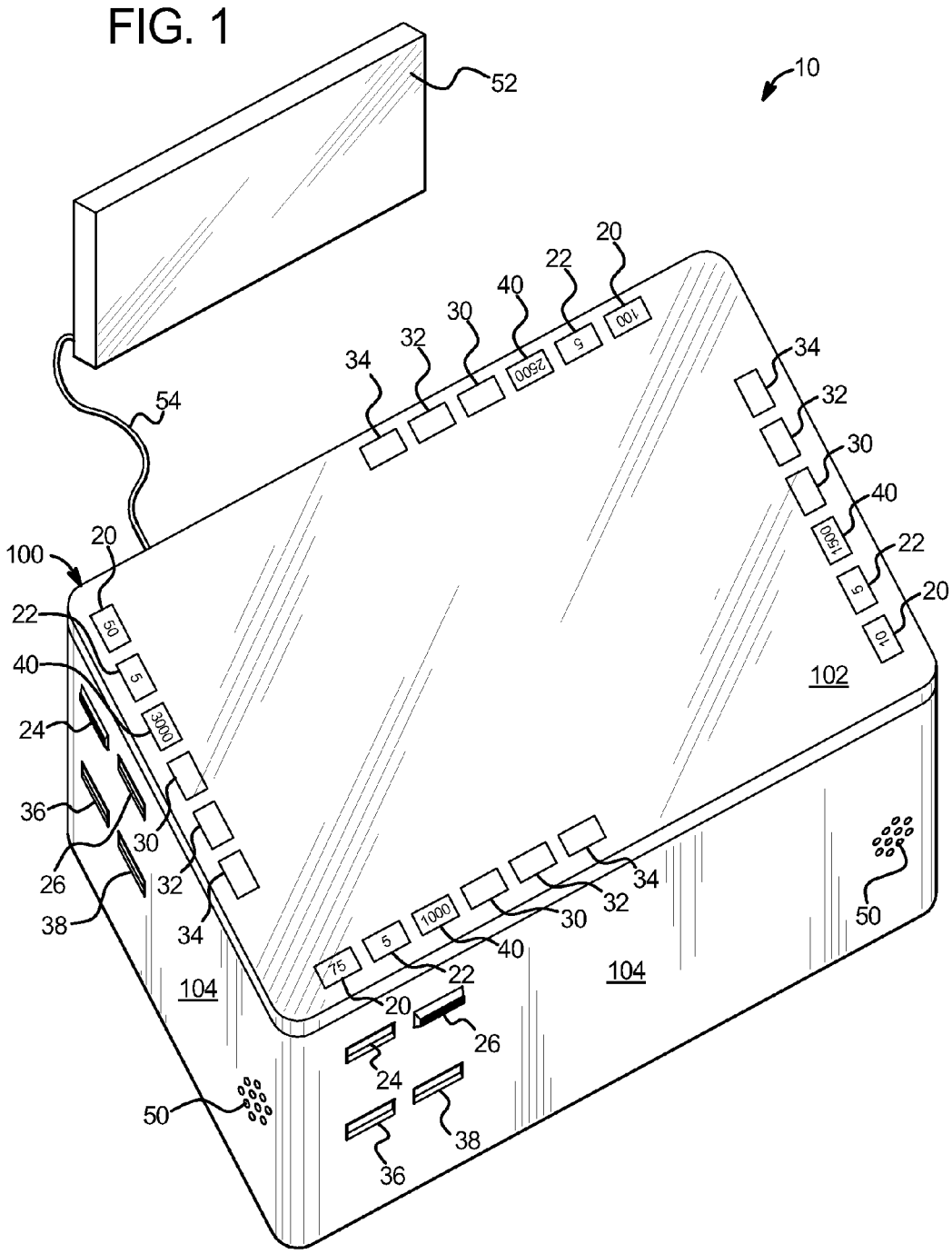
FIG. 1 is a perspective view of one embodiment of a gaming system having the multiple player simultaneous display/input table of the present disclosure.

Referring now to the drawings, gaming system 10 as shown in FIG. 1 is one embodiment a multiple player simultaneous display/input device gaming system of the present disclosure. Gaming system 10 may be implemented in various configurations including but not limited to: (1) a dedicated gaming system in which the computerized instructions for controlling any games (which are provided by the gaming system) are provided with the gaming system prior to delivery to a gaming establishment; and (2) a changeable gaming system in which the computerized instructions for controlling any games (which are provided by the gaming system) are downloadable to the gaming system through a data network after the gaming system is installed at a gaming establishment.

In one embodiment, the computerized instructions for controlling any games are executed by at least one central server, central controller, or remote host. In such a "thin client" embodiment, the central server remotely controls any games (or other suitable interfaces), and gaming system is utilized to display such games (or suitable interfaces) and receive one or more inputs or commands from one or more players.

In another embodiment, the computerized instructions for controlling any games are communicated from the central server, central controller, or remote host to a gaming system local processing and memory. In such a "thick client" embodiment, gaming system local processing executes the communicated computerized instructions to control any games (or other suitable interfaces) provided to a player.

In one embodiment, one or more gaming systems in a network of multiple gaming systems may be a thin client gaming system and one or more gaming system in the network may be a thick client gaming system. In another embodiment, certain functions of gaming system are implemented in a thin client environment and certain other functions of gaming system are implemented in a thick client environment. In one such embodiment, computerized instructions for controlling any primary games are communicated from the central server to gaming system in a thick client configuration and computerized instructions for controlling any secondary games or bonus functions are executed by a central server in a thin client configuration.

The gaming system 10 includes a game table housing a support structure, housing, or cabinet, which provides support for a multi-touch display/input device and other features needed for a gaming machine. It is configured so that a player can operate it while standing or sitting. It should be appreciated that the game table can be configured in other suitable manners.

Figure 2A:
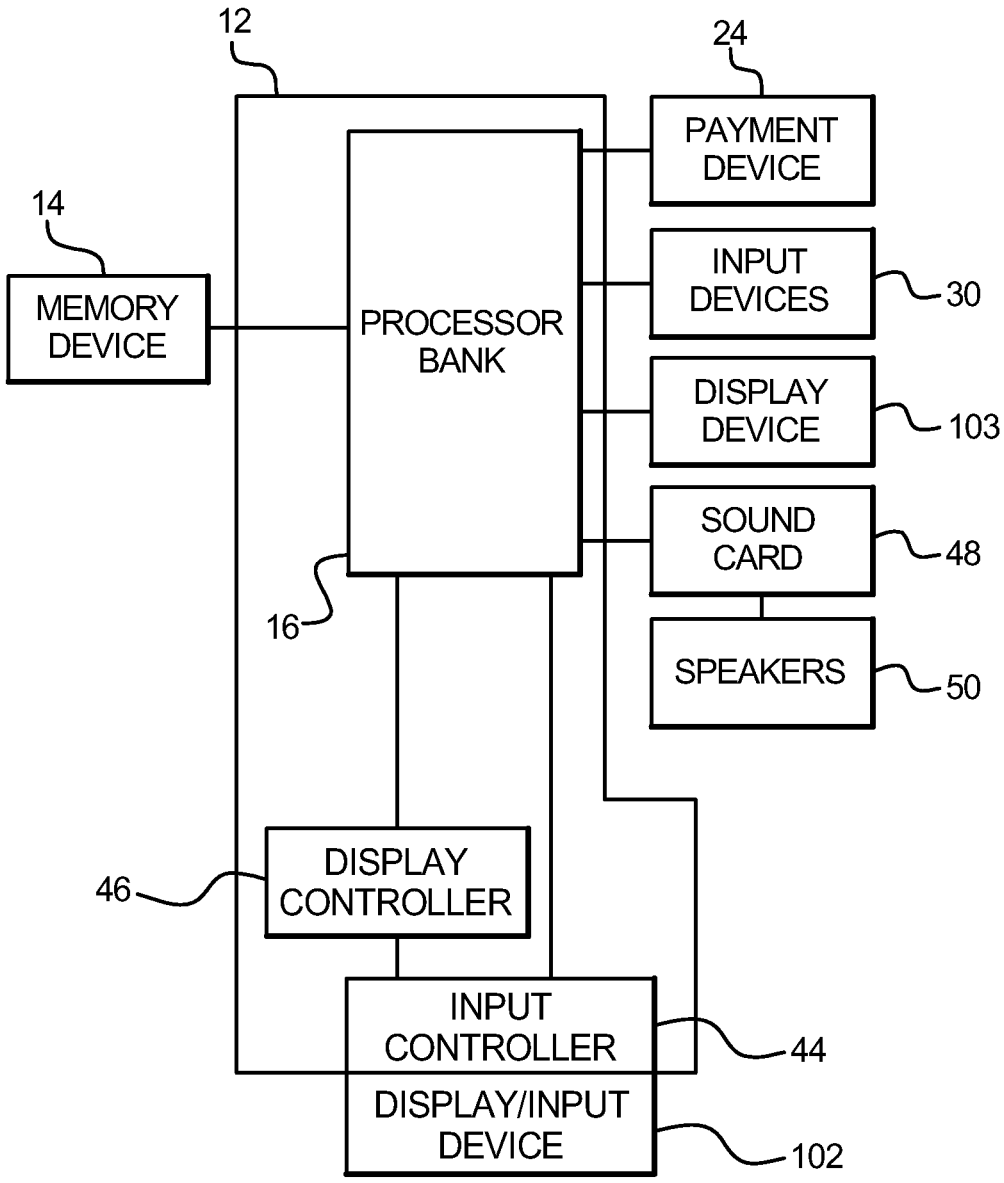
FIG. 2A is a schematic view of one embodiment for an electrical configuration for the multiple player simultaneous display/input game table of the present disclosure.

As seen additionally in FIG. 2A, gaming system 10 includes a plurality of processors or processor bank 16, which can for example include a primary processor in communication with a plurality of delegate processors. For purposes of this description, "processing 12" refers to the entire processing apparatus and functioning, including the multiple individual processors of bank 16. The individual processors can be any suitable combination of microprocessors, integrated circuits or application-specific integrated circuits ("ASIC's"). Processing 12 is in communication with or operable to access or to exchange signals with at least one data storage or memory device. For purposes of this description, "memory 14" refers to the entire memory or storage apparatus and its functioning, including multiple individual memory devices. In one embodiment, processing 12 and memory 14 reside within a multiple player game table 100 that enables multiple players to input information simultaneously into gaming system 10.

Memory 14 stores program code and instructions, executable by processing 12, to control gaming system 10. Memory 14 also stores other data such as image data, event data, player input data, random or pseudo-random number generators, physics engine, pay-table data or information, and applicable game rules that relate to the play of gaming system 10. In one embodiment, memory 14 includes any one or more of random access memory ("RAM"), which can include non-volatile RAM ("NVRAM"), magnetic RAM ("MRAM"), ferroelectric RAM ("FeRAM"), and other forms as commonly understood in the gaming industry, read only memory ("ROM"), flash memory and/or electrically erasable programmable read only memory ("EEPROM").

In one embodiment, part or all of the program code and/or operating data described above can be stored in a detachable or removable memory device, including, but not limited to, a suitable cartridge, disk, compact disk ("CD") ROM, digital video disk ("DVD"), or universal serial port ("USB") memory device. In other embodiments, part or all of the program code and/or operating data described above can be downloaded to memory 14 through a network.

In one embodiment, gaming system 10 is operable over a wireless network, for example as part of a wireless gaming system. It should be appreciated that a gaming system may be a device that has obtained approval from a regulatory gaming commission or a device that has not obtained approval from a regulatory gaming commission.

In various embodiments, gaming system 10 randomly generates awards and/or other game outcomes based on probability data. In one such embodiment, this random determination is made via a random number generator ("RNG"), such as a true random number generator, a pseudo random number generator, physics engine, or other suitable randomization process. In one embodiment, each award or other game outcome is associated with a probability, wherein gaming system 10 generates the award or other game outcome to be provided to the player based on the associated probabilities. Here, since gaming system 10 generates outcomes randomly or based upon one or more probability calculation, there is no certainty that gaming system 10 will ever provide the player with any specific award or other game outcome.

In another embodiment, as discussed in more detail below, gaming system 10 employs a predetermined or finite set or pool of awards or other game outcomes. Here, as each award or other game outcome is provided to the player, gaming system 10 flags or removes the provided award or other game outcome from the predetermined set or pool. Once flagged or removed from the set or pool, the specific provided award or other game outcome from that specific pool cannot be provided to the player again. This type of gaming system provides players with all of the available awards or other game outcomes over the course of the play cycle and guarantees the amount of actual wins and losses.

One suitable table for gaming system 10 of the present disclosure is provided by Microsoft Corporation, Redmond, Wash., which uses a technology descried in U.S. Pat. No. 7,204,428 ("the '428 patent). This so-called surface computing technology employs an acrylic top and a plurality of infrared cameras and a DLP projector with Wl-FI™ and BLUETOOTH™ wireless networks to display and detect objects and movement. As players move their hands or objects on or above the table top, the cameras translate the motions into commands. BLUETOOTH is a trademark of Bluetooth SIG, Inc. In certain embodiments, the technology includes the application of a coded pattern applied to an external object. The interactive display/input device identifies the object when it is on the surface of the display/input device 102 of the game table 100. More specifically, gaming system 10 includes a plurality of infrared ("IR") video cameras located beneath surface display/input device 102, on an opposite side of the display/input device surface from the object. The cameras detect reflected infrared ("IR") light received from a coded pattern printed on the object, e.g., playing card or dice. The coded pattern is in various example embodiments a circular printed pattern, a linear printed pattern, a single level matrix printed pattern, a variable bit length matrix printed pattern, a multi-level matrix printed pattern, a black/white (i.e., binary) printed pattern, a gray scale pattern printed, or other suitable pattern disposed on the object. The coded pattern may be employed on any suitable object (such as a playing card or dice). The coded pattern is an identifier of the object or part of the object. For example, the identifier can tell processing 12 and memory 14 operable with the plurality of cameras that the object is a particular playing card, particular dice face, a particular token, or particular wagering or other chip. It should also be appreciated that the coded pattern can be applied to other object such as player gloves and player charms. It should further be appreciated that in the future the display/input device of the game table can be further refined to identify a player's personal identification such as the player's finger prints and that the gaming system can be configured to compare such identifications to identifications in a database.

It should be appreciated that the coded patterns are passive in the sense that they do not send or transmit any electrical signals to the display/input device of the game table. Rather, the display/input device is configured to identify (such as by reading or sensing) the coded pattern based on the light reflected from the coded pattern. It should further be appreciated that the coded pattern can be printed on or attached to a device that includes a transmitter and a receiver that are capable of sending electronic signals to and receiving electronic signals from the gaming system or game table. Thus, while such devices are not considered passive with respect to the transmission of such electronic signals, such coded patterns on such device are considered passive. It should also be appreciated that other suitable devices which provide passive image recognition may be employed in accordance with the present disclosure.

In certain embodiments, objects such are cards, dice, chips and wheels are displayed by the game table 100 of gaming system 10. The cameras operate to sense when the displayed cards have been touched by a player or dealer. Processing 12 and memory 14 of game table 100 are modified for this purpose. For example, processing 12 and memory 14 are modified to allow a card or dice to be touched by an actual dealer, who slides the card to the player, and thereafter be handled by the player. Alternatively, processing 12 and memory 14 are configured to provide a virtual dealer who deals a card to the player, and thereafter enable the player to manipulate the displayed card.

Game table 100 displays a primary game, which is a multiple player or player versus player game in one embodiment. Game table 100 may also display any suitable secondary or bonus game associated with the primary game as well as information relating to the primary or secondary game.

As seen in FIG. 1, gaming system 10 for each player includes a credit display 20, which displays a player's current number of credits, cash, account balance, or the equivalent. Gaming system 10 can also display a bet display 22 for each player, which displays a player's amount wagered. In one embodiment, as described in more detail below, gaming system 10 includes a player tracking display 40 for each player, which displays information regarding a player's play tracking status. In one embodiment, game table 100 only shows the above displays 20, 22 and/or 40 at certain times such as between hands of blackjack, so that surface display/input device 102 of game table 100 can be conserved for base or bonus play.

For the base and bonus games, game table 100 of gaming system 10 is configured to display at least one and a plurality of game or other suitable images, symbols and indicia such as any visual representation or exhibition of the movement of objects such as virtual, or video reels and wheels, dice, cards, dynamic lighting, video images, images of people, characters, places, things, faces of cards, and the like.

Any desired player item displayed on game table 100 can be touched, dragged, and resized if it is desirable to do so. Multiple players can touch and move multiple displayed objects simultaneously as discussed above and below. Further, processing 12 and memory 14 are configured such that items can be under control of gaming system 10 at one time and position and be under control of one of the players at another time and position. Other indicia, such as manufacturer label and game name, may be displayed as desired permanently at one or more positions on game table 100.

As seen in FIG. 1, gaming system 10 in one embodiment includes a secondary such as a large overhead display device 52, which is configured to communicate with game table 100 wirelessly or via a cable 54. Large overhead display device 52 can be seen by each of the players playing gaming system 10 and by nearby patrons. Secondary display device 52 can show any desired information relating to a primary or bonus game being played at game table 100, credit information, player tracking information and/or player attraction indicia.

As illustrated in FIGS. 1 and 2A, in one embodiment, gaming system 10 includes at least one payment device 24 such as a separate payment device 24 for each player, in communication with processing 12. As seen in FIG. 1, a payment device 24 can be a note, ticket or bill acceptor in which the player inserts paper money, a ticket or voucher. Game table 100 can alternatively or additionally include a coin slot 26 in which the player inserts money, coins or tokens. Further alternatively, game table 100 can include a reader or validator for credit cards, debit cards or credit slips for payment acceptance. In one embodiment, a player may insert an identification card into a card reader of gaming system 10, which can be a smart card having a programmed microchip or a magnetic strip encoded with a player's identification, credit totals (or related data), and other relevant information. In another embodiment, a player may carry a portable device, such as a cell phone, a radio frequency identification tag, or any other suitable wireless device, which communicates a player's identification, credit totals (or related data), and other relevant information to gaming system 10. In one embodiment, money may be transferred to a gaming device through an electronic funds transfer. When a player funds gaming system 10, processing 12 determines the amount of funds entered and displays the corresponding amount on the credit or other suitable display as described above.

As seen in FIGS. 1 and 2A, in one embodiment gaming system 10 includes a plurality of game table input devices, such as a bet one button 30 in communication with processing 12. The game table input devices enable the player to produce an input signal, which is received by processing 12. Game table 100 provides a bet one button 30 to place a bet. The player can increase the bet by one credit each time the player pushes the bet one button 30. When the player pushes the bet one button 30, the number of credits shown in the credit display decreases by one, and the number of credits shown in the bet display increases by one. In another embodiment, one input device is a bet max button (not shown) which enables the player to bet the maximum wager permitted for a game of gaming system 10 in one button push.

For individual gaming, after appropriate funding of gaming system 10, the player uses a game activation device, such as a play button 32, to start any primary game or sequence of events in gaming system 10. Play button 32 can be any suitable play activator such as a bet one button, a max bet button, or a repeat the bet button. In one embodiment, e.g., for multiple player gaming, upon appropriate funding, gaming system 10 begins the game play automatically. In another embodiment, multiple play buttons 32, e.g., one for each player are provided, wherein game play begins when any player touches his/her play buttons 32.

Game table 100 can also include a cash out button 34, e.g., one for each player. Each player can push the cash out button 34 and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and redeems the value associated with the ticket or credit slip via a cashier (or other suitable redemption system). In another embodiment, when the player cashes out, the player receives the coins or tokens in a coin payout tray (not shown). Alternatively or additionally, gaming system 10 funds credits to each player's electronically recordable identification card.

Game table 100 provides a multi-player multi-touch display/input device, which can employ, for example, the technology set forth in the '428 patent. As seen in the diagrammatic example of FIG. 2A, the display/input device 102 is controlled by a suitable controller 44, which is part of processing 12. The display/input device 102 and the controller 44 are connected to a display controller 46, which is also part of processing 12. Multiple players can make decisions and input signals simultaneously into gaming system 10 by touching device (or the surface of device) 102 at the appropriate locations.

In addition to the display/input device, should also be appreciated that certain of the input devices discussed above can be provided as touch-screen inputs or as electromechanical inputs located on one or more of the sides 104 of game table 100. It should also be appreciated that if in touch-screen form, the function(s) of any of these input devices can be alternatively provided by the display/input device 102.

Gaming system 10 may further include a plurality of communication ports for enabling communication of processing 12 with external peripherals, such as external video sources, expansion buses, game or other displays, a SCSI port, or a keypad. As illustrated, gaming system 10 optionally includes a remote, e.g., large overhead display device 52, which can display certain features of the base or bonus game, e.g., show how many bonus chips or items each player has accumulated.

In one embodiment, as seen in FIG. 2A, gaming system 10 includes a sound generating device controlled by one or more sounds cards 48, which is part of processing 12, and is operable with a sound generating device, such as a speaker 50. Sound card 48 and speaker 50 can play music for the primary and/or secondary game and for other modes of gaming system 10, such as an attract mode. In one embodiment, gaming system 10 provides dynamic sounds coupled with attractive multimedia images displayed on game table 100 to provide an audio-visual representation or to otherwise display full-motion video with sound to attract players to gaming system 10. During idle periods, gaming system 10 may display a sequence of audio and/or visual attraction messages to attract potential players to gaming system 10. The videos may be customized according to a game theme associated with gaming system 10.

Figure 2B:
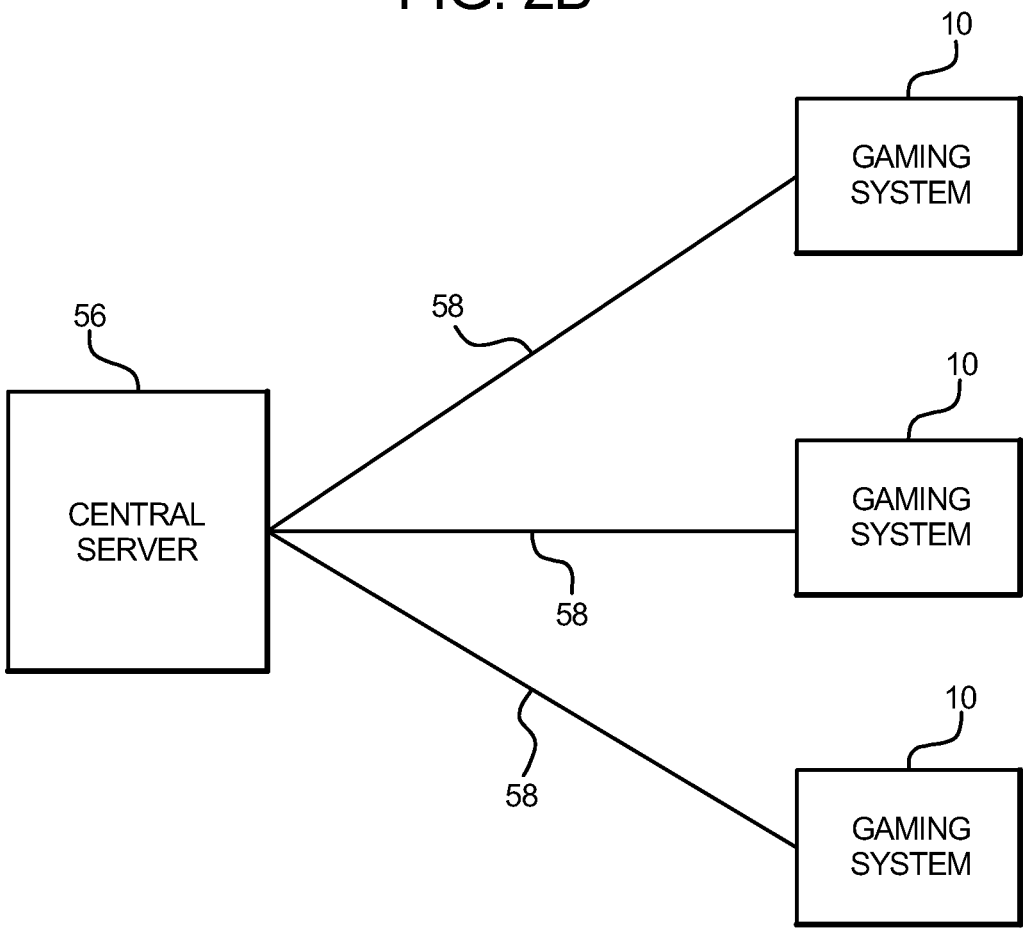
FIG. 2B is a schematic view of one embodiment for a server based configuration networking a plurality of the multiple player simultaneous display/input device game tables of the present disclosure.

In one embodiment, as illustrated in FIG. 2B, one or more of the gaming systems 10 is in communication with each other and/or at least one central server, central controller or remote host 56 through a data network or remote communication link 58. In this embodiment, the central server, central controller or remote host 56 is a server or computing device that includes at least one processor and at least one memory or storage device. In such embodiments, the central server 56 is a progressive controller or a processor of one of gaming systems 10 in the network. In these embodiments, processing 12 of each gaming system 10 is designed to transmit and receive events, messages, commands, or any other suitable data or signal between individual gaming systems 10 and central server 56. Processing 12 of gaming system 10 is configured to execute the above communicated events, messages or commands in conjunction with the operation of gaming system 10. Moreover, processing 12 of central server 56 is configured to transmit and receive events, messages, commands or any other suitable data or signal between central server 56 and each of the individual gaming systems 10. The central server processor is operable to execute such communicated events, messages or commands in conjunction with the operation of central server 56. It should be appreciated that one, more or each of the functions of the central server 56 as disclosed herein may be performed alternatively at processing 12. It should be further appreciated that one, more or each of the functions of processing 12 may be performed by the central server processing.

In one embodiment, the game outcome provided to the player is determined by central server 56 and provided to the player(s) at gaming system 10. Here, each of a plurality of such gaming systems 10 is in communication with central server 56. Upon a player initiating game play at one of gaming systems 10, the initiated gaming system 10 communicates a game outcome request to the central server 56.

In one embodiment, the central server 56 receives the game outcome request and randomly generates a game outcome for the primary game based on probability data. In another embodiment, central server 56 generates a game outcome randomly for the secondary game based on probability data. Here, central server 56 generates a game outcome randomly for both the primary game and the secondary game based on probability data. In this embodiment, the central server 56 is capable of storing and using program code or other data similar to processing 12 and memory 14 of gaming system 10.

In an alternative embodiment, central server 56 maintains one or more predetermined pools or sets of predetermined game outcomes. Here, the central server 56 receives the game outcome request and independently selects a predetermined game outcome from a set or pool of game outcomes. Central server 56 flags or marks the selected game outcome as used. Once a game outcome is flagged as used, it is prevented from further selection from the set or pool and cannot be selected by central server 56 upon another wager. The provided game outcome can include a primary game outcome, a secondary game outcome, primary and secondary game outcomes, or a series of game outcomes such as free games.

Central server 56 communicates the generated or selected game outcome to the initiated gaming system 10. Gaming system 10 receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by central server 56 and communicated to the initiated gaming system 10 to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno or lottery game. Here, each individual gaming system 10 uses one or more bingo, keno, or lottery game to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming system 10 is enrolled in the bingo game, such as upon an appropriate wager or engaging an input device, the enrolled gaming system 10 is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards, while another element may solely be present on one of the bingo cards.

In operation of these embodiments, upon providing or associating a different bingo card with each of a plurality of enrolled gaming systems 10, central server 56 randomly selects or draws, one at a time, a plurality of the elements. As each element is selected, a determination is made for each gaming system 10 as to whether the selected element is present on the bingo card provided to that enrolled gaming system 10. This determination can be made at central server 56, gaming system 10, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined pattern is marked on one or more of the provided bingo cards. It should be appreciated that in one embodiment, gaming system 10 requires the player to engage a daub button (not shown) to initiate the process of gaming system 10 marking or flagging any selected elements.

After one or more predetermined patterns is marked on one or more of the provided bingo cards, a game outcome is determined for each of the enrolled gaming system 10 based, at least in part, on the selected elements on the provided bingo cards. As described above, the game outcome determined for each gaming system 10 enrolled in the bingo game is used by that gaming system 10 to determine the predetermined game outcome provided to the player. For example, a first gaming system 10 to have selected elements marked in a predetermined pattern is provided a first outcome of win $10, which is provided to a first player regardless of how the first player plays in a first game, and a second gaming system 10 to have selected elements marked in a different predetermined pattern is provided a second outcome of win $2, which is provided to a second player regardless of how the second player plays a second game. It should be appreciated that as the process of marking selected elements continues until one or more predetermined pattern is marked, this embodiment ensures that at least one bingo card wins the bingo game and thus at least one enrolled gaming system 10 provides a predetermined winning game outcome to a player. It should be appreciated that other suitable methods for selecting or determining one or more predetermined game outcome may be employed.

In one example of the above-described embodiment, the predetermined game outcome may be based on a supplemental award in addition to any award provided for winning the bingo game as described above. Here, if one or more element is marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming system 10 may be provided a supplemental or intermittent award regardless of whether the enrolled gaming system's provided bingo card wins or does not win the bingo game as described above.

In another embodiment, one or more of gaming systems 10 is in communication with central server 56 for monitoring purposes only. That is, each individual gaming system 10 randomly generates the game outcomes to be provided to the player, and the central server 56 monitors the activities and events occurring on the plurality of gaming systems 10. In one embodiment, the gaming network includes a real-time or on-line accounting and gaming information system coupled operably to central server 56. The accounting and gaming information system of this embodiment includes a player database for storing player profiles, a player tracking module for tracking players and a credit system for providing automated casino transactions.

In one embodiment, gaming system 10 is associated with or otherwise integrated with one or more player tracking system. Player tracking systems enable gaming establishments to recognize the value of customer loyalty through identifying frequent customers and rewarding them for their patronage. In one embodiment, gaming system 10 and/or the player tracking system tracks any player's gaming activity at gaming system 10. In one such embodiment, gaming system 10 includes at least one card reader 38, located, e.g., at a side 104 of game table 100, which is in communication with processing 12. Here, a player is issued a player identification card that has an encoded player identification number that uniquely identifies the player. When a player inserts their playing tracking card into card reader 38 to begin a gaming session, card reader 38 reads the player identification number off the player tracking card to identify the player. Gaming system 10 and/or the associated player tracking system timely tracks information or data relating to the identified player's gaming session.

Directly or via the central server 56, processing 12 of gaming system 10 communicates such information to the player tracking system. Gaming system 10 and/or associated player tracking system also timely tracks when a player removes their player tracking card when concluding play for that gaming session. In another embodiment, rather than requiring a player to insert a player tracking card, gaming system 10 uses one or more portable device carried by a player, such as a cell phone, a radio frequency identification tag or any other suitable wireless device to track when a player begins and ends a gaming session. In another embodiment, gaming system 10 utilizes any suitable biometric technology or ticket technology to track when a player begins and ends a gaming session.

It should also be appreciated that the current player tracking cards can be modified to be read by the IR cameras. For example, the player tracking cards can include an IR tag instead of or in addition to the magnetic strip currently on the card readers.

During one or more gaming session, the player tracking system tracks player information or data, such as any amounts wagered, average wager amounts, and/or the time at which these wagers are placed. In different embodiments, for one or more player, the player tracking system includes the player's account number, the player's card number, the player's first name, the player's surname, the player's preferred name, the player's player tracking ranking, any promotional status associated with the player's player tracking card, the player's address, the player's birthday, the player's anniversary, the player's recent gaming sessions or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service window (not shown), which is displayed on surface of display/input device 102 of game table 100.

In one embodiment, a plurality of gaming systems 10 are capable of being connected together through a data network. In one embodiment, the data network is a local area network ("LAN"), in a plurality of gaming systems 10 are located proximate to each other and an on-site central server or controller as in, for example, a gaming establishment or a portion of a gaming establishment. In another embodiment, the data network is a wide area network ("WAN"), in which a plurality of the gaming systems 10 are in communication with at least one off-site central server. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. Here, operation of gaming system 10 and accumulation of credits may be accomplished with only a connection to the central server 56 (the internet/intranet server) through a conventional phone or other data transmission line, digital subscriber line (DSL), T-1 line, coaxial cable, fiber optic cable, or other suitable connection. Players may access an internet game page from any location in which an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices is in communication with a central server 56. In one embodiment, the memory of central server 56 stores different game programs and instructions, executable by gaming system processing 12, to control gaming system 10. Each executable game program represents a different game or type of game, which may be played on one or more gaming system 10 in the network. Such different games may include the same or substantially the same game play with different pay tables. In different embodiments, the executable game program is for a primary game, a secondary game or both. In another embodiment, the game program may be executed as a secondary game to be played simultaneous with the play of a primary game (which may be downloaded to or fixed on gaming system 10) or vice versa.

In operation, central server 56 communicates one or more of the stored game programs to local processing 12 of at least one gaming system 10. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet or telephone line. After the stored game programs are communicated from the central server 56, local processing 12 executes the communicated program to facilitate play of the communicated program by a player through game table 100 of gaming system 10. That is, when a game program is communicated to local processing 12, the local processing changes the game or type of game played at gaming system 10.

In another embodiment, a plurality of gaming systems 10 at one or more gaming site are networked to central server 56 in a progressive configuration, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming systems 10 distributed throughout a number of properties at different geographical locations including, for example, different locations within a city or different cities within a state.

In one embodiment, the progressive gaming system host site computer is maintained for the overall operation and control of the progressive gaming system. Here, a progressive gaming system host site computer oversees the entire progressive gaming system and is the master for computing all progressive jackpots. All participating gaming sites report to, and receive information from, the progressive gaming system host site computer. Each central server 56 is responsible for all data communication between gaming system 10 hardware and software and the progressive gaming system host site computer. In one embodiment, an individual gaming system 10 may trigger a progressive award win. In another embodiment, a central server 56 (or the progressive gaming system host site computer) determines when a progressive award win is triggered. In a further embodiment, an individual gaming system 10 and a central server 56 (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, gaming system 10 is randomly or apparently randomly selected to provide a player of that gaming system one or more progressive award. In one such embodiment, gaming system 10 does not provide any apparent reason to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards is each funded via a side bet or side wager. Here, a player places or wagers a side bet to be eligible to win the progressive award associated with the side bet. In one embodiment, the player has to place the maximum bet and the side bet to be eligible to win one of the progressive awards. In another embodiment, if the player places or wagers the required side bet, the player may wager any credit amount during the primary game (the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of gaming system 10, via a gaming establishment or via any suitable manner.

In another embodiment, one or more of the progressive awards is partially funded via a side-bet or side-wager which the player may make (and which may be tracked via a side-bet meter). In a further embodiment, one or more of the progressive awards is funded with only side-bets or side-wagers placed. In still another embodiment, one or more of the progressive awards is funded based on players' wagers as described above as well as any side-bets or side-wagers placed.

In still a further alternative embodiment, a minimum wager level is required for a gaming system 10 to qualify to be selected to obtain one of the progressive awards. In one embodiment, this minimum wager level is the maximum wager level for the primary game in gaming system 10. In another embodiment, no minimum wager level is required for a gaming machine to qualify to be selected to obtain one of the progressive awards.

As described in more detail below, a plurality of players at a plurality of linked gaming systems 10 participate in a group gaming environment. In one embodiment, a plurality of players at a plurality of linked gaming systems work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming systems 10 compete against one another for one or more awards. In one such embodiment, a plurality of players at a plurality of linked gaming systems 10 participate in a gaming tournament for one or more awards. In another embodiment, a plurality of players at a plurality of linked gaming systems 10 play for one or more award, wherein an outcome generated by one gaming system 10 affects the outcomes generated by one or more other linked gaming system.

Gaming system 10 can incorporate any suitable wagering game as the primary or base game. The primary or base game may comprise a single player game, such as a reel-type game, card game, cascading or falling symbol game, number game, or other game of chance that can be configured in an electronic form, which in one embodiment produces a random outcome based on probability data at the time of or after placement of a wager. Gaming system 10 can be configured to play video poker, video blackjack, video keno, video bingo or baccarat, for example, in single player format or in table game format, e.g., multiple blackjack players against a dealer or multiple poker players playing against one another.

In one embodiment, gaming system 10 displays a slot game that may be a base or bonus game for the gaming system. In the slot game of gaming system 10, game table 100 displays multiple paylines, which may be horizontal, vertical, circular, diagonal, angled or any combination thereof. The paylines operate with at least one reel, such as three to five reels. Each reel includes a plurality of indicia or symbols, such as bells, hearts, fruits, numbers, letters, bars, or other images which correspond to a theme associated with gaming system 10. In another embodiment, one or more of the reels are independent reels or unisymbol reels. In this embodiment, each independent or unisymbol reel generates and displays one symbol to the player. The slot version of gaming system 10 awards prizes after the reels stop spinning if specified types and/or configurations of indicia or symbols occur on an active payline.

In an alternative embodiment, rather than determining any outcome to provide to the player by analyzing the symbols generated on any wagered upon paylines as described above, gaming system 10 determines any outcome to provide to the player based on the number of associated symbols which are generated in active symbol positions on the requisite number of adjacent reels (i.e., not on paylines passing through any displayed winning symbol combinations). Here, if a winning symbol combination is generated on the reels, gaming system 10 provides the player one award for that occurrence of the generated winning symbol combination. For example, if one winning symbol combination is generated on the reels, gaming system 10 provides a single award to the player for that winning symbol combination (e.g., not based on the number of paylines that would have passed through that winning symbol combination). Here, the slot game may provide the player more than one award for the same occurrence of a single winning symbol combination (e.g., if a plurality of paylines each pass through the same winning symbol combination).

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of gaming system 10 with at least one symbol generated in an active symbol position. For example, a three reel gaming system 10 with three symbols generated in active symbol positions on each reel includes twenty-seven ways to win (e.g., three symbols on the first reel×three symbols on the second reel×three symbols on the third reel). A four reel gaming system 10 with three symbols generated in active symbol positions on each reel includes eighty-one ways to win (e.g., three symbols on the first reel×three symbols on the second reel×three symbols on the third reel×three symbols on the fourth reel). A five reel gaming system 10 with three symbols generated in active symbol positions on each reel includes 243 ways to win (e.g., three symbols on the first reel×three symbols on the second reel×three symbols on the third reel×three symbols on the fourth reel×three symbols on the fifth reel). It should be appreciated that modifying the number of generated symbols by either modifying the number of reels or modifying the number of symbols generated in active symbol positions by one or more of the reels modifies the number of ways to win.

In another embodiment, the slot version of gaming system 10 enables a player to wager on and thus activate symbol positions. In one such embodiment, the symbol positions are on the reels. Here, if based on the player's wager, a reel is activated, then each of the symbol positions of that reel is activated and each of the active symbol positions is part of one or more of the ways to win. In another embodiment, if based on the player's wager, a reel is not activated, then a designated number of default symbol positions, such as a single symbol position of the middle row of the reel, is activated and the default symbol position(s) is/are part of one or more of the ways to win. This type of gaming machine enables a player to wager on one, more than one, or all of the reels of gaming system 10. Processing 12 uses the number of wagered-on reels to determine the active symbol positions and the number of possible ways to win.

In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment in which a player wagers on one or more reel, a player's wager of one credit may activate each of the three symbol positions on a first reel, wherein one default symbol position is activated on each of the remaining four reels. In this example, as described above, the slot version of gaming system 10 provides the player three ways to win (e.g., three symbols on the first reel×one symbol on the second reel×one symbol on the third reel×one symbol on the fourth reel×one symbol on the fifth reel). In another example, a player's wager of nine credits activates each of the three symbol positions on a first reel, each of the three symbol positions on a second reel and each of the three symbol positions on a third reel, wherein one default symbol position is activated on each of the remaining two reels. In this example, as described above, gaming system 10 provides the player twenty-seven ways to win (e.g., three symbols on the first reel×three symbols on the second reel×three symbols on the third reel×one symbol on the fourth reel×one symbol on the fifth reel).

In one embodiment, to determine any award(s) to provide to the player based on the generated symbols, gaming system 10 individually determines if a symbol generated in an active symbol position on a first reel forms part of a winning symbol combination with or is otherwise suitably related to a symbol generated in an active symbol position on a second reel. Here, gaming system 10 classifies each pair of symbols that form part of a winning symbol combination (e.g., each pair of related symbols) as a string of related symbols. For example, if active symbol positions include a first cherry symbol generated in the top row of a first reel and a second cherry symbol generated in the bottom row of a second reel, gaming system 10 classifies the two cherry symbols as a string of related symbols because the two cherry symbols form part of a winning symbol combination.

After determining if any strings of related symbols are formed between the symbols on the first reel and the symbols on the second reel, gaming system 10 determines if any of the symbols from the next adjacent reel should be added to any of the formed strings of related symbols. Here, for a first of the classified strings of related symbols, gaming system 10 determines if any of the symbols generated by the next adjacent reel form part of a winning symbol combination or are otherwise related to the symbols of the first string of related symbols. If gaming system 10 determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the slot version of gaming system 10 adds the related cherry symbol generated on the third reel to the previously classified string of cherry symbols.

On the other hand, if gaming system 10 determines that no symbols generated on the next adjacent reel are related to the symbols of the first string of related symbols, the slot version of gaming system 10 marks or flags such string of related symbols as complete. For example, if the first string of related symbols is the string of related cherry symbols and none of the symbols of the third reel are related to the cherry symbols of the previously classified string of cherry symbols, gaming system 10 marks or flags the string of two cherry symbols as complete.

After either adding a related symbol to the first string of related symbols or marking the first string of related symbols as complete, the slot version of gaming system 10 proceeds as described above for each of the remaining classified strings of related symbols which were previously classified or formed from related symbols on the first and second reels.

After analyzing each of the remaining strings of related symbols, the slot version of gaming system 10 determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, gaming system 10 marks each of the remaining pending strings of related symbols as complete.

When each of the strings of related symbols is marked complete, the slot version of gaming system 10 compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

Poker Game Example Embodiments

In one embodiment, game table 100 of gaming system 10 displays a poker game, in which the player plays a conventional game of video draw poker and initially deals five cards all face up from a virtual deck of fifty-two cards. Cards may be dealt as in a traditional game of cards, e.g., from the top of the deck or the cards may be randomly selected from a predetermined number of cards. If the player wishes to draw a card, the player selects the cards to hold via the display/input device. The player presses a deal button, which can be virtual and the unwanted or discarded cards are removed from surface of display/input device 102 of game table 100. The poker version of gaming system 10 deals the replacement cards from the remaining cards in the deck. This results in a final five-card hand. Gaming system 10 compares the final five-card hand to a payout table which utilizes conventional poker hand rankings to determine the winning hands. Gaming system 10 provides the player with an award based on a winning hand and the number of credits the player wagered.

In another embodiment, the poker version of gaming device 100 plays a multi-hand version of video poker. Here, gaming system 10 deals the player at least two hands of cards. In one embodiment each hand of cards is associated with its own deck of cards. The player chooses the cards to hold in a primary hand. The held cards in the primary hand are also held in the other hands of cards. The remaining non-held cards are removed from each hand displayed and replacement cards are dealt randomly into each hand. Since the replacement cards are dealt randomly and independently for each hand, the replacement cards for each hand can and usually will be different. The poker hand rankings are then determined hand by hand against a payout table and awards are provided to the player.

As discussed herein, game table 100 is particularly well-suited for multiple player, interactive gaming in which multiple players play at the same time against a dealer or against each other. It is accordingly expressly contemplated to provide a video poker game on interactive game table 100 in which players play against each other. A deck of cards moves from player to player, each player taking turns as dealer. Alternatively, a separate (actual or virtual dealer) deals the cards to the group of players. The dealing of virtual cards is discussed in detail below.

The poker game can be any suitable poker game. For example, the poker game can be a five card stud game in which four cards are dealt face-up. The players then raise or fold. The fifth card is then dealt face-up and the winning player is awarded the pot.

Figure 3:
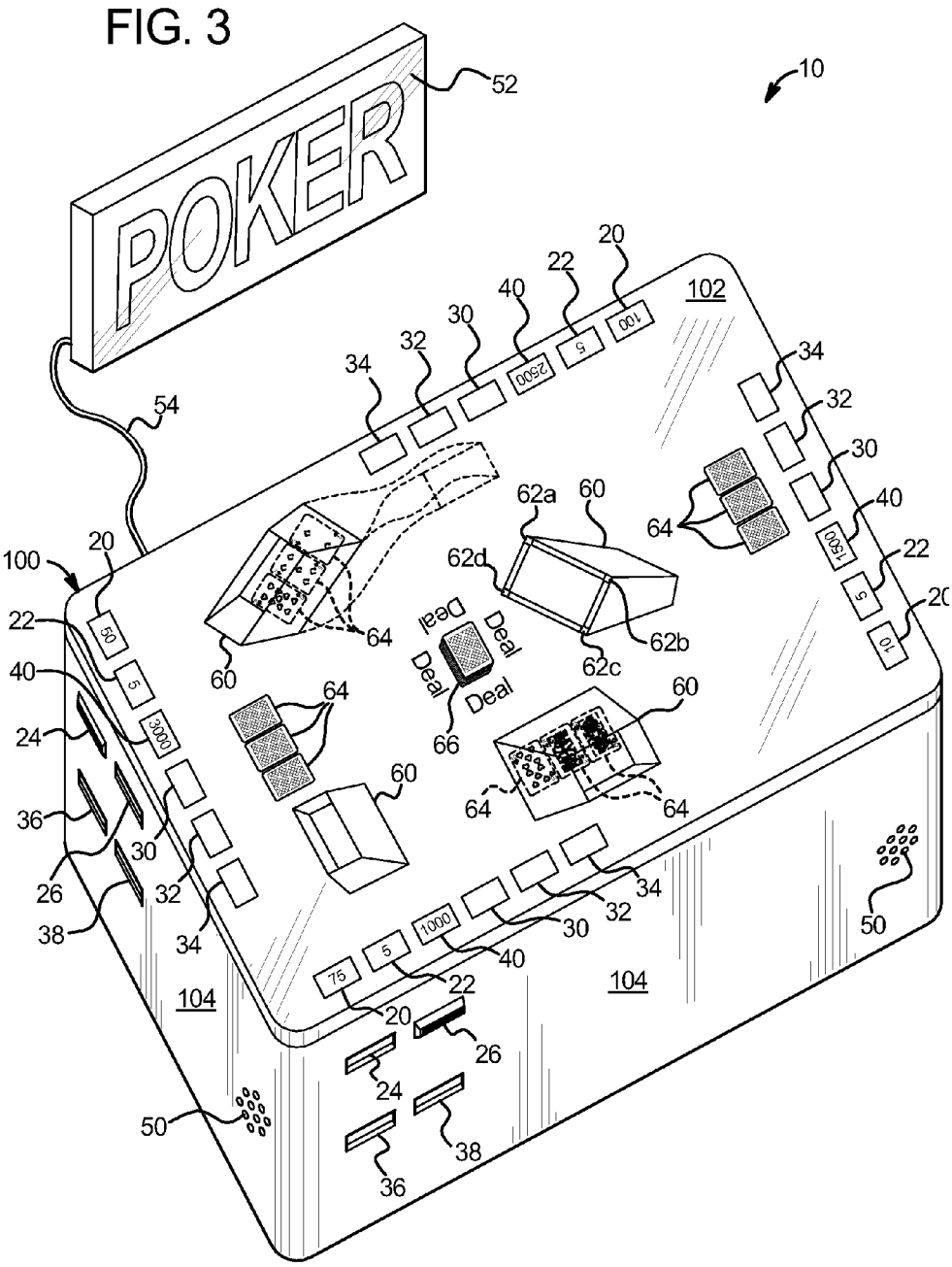
FIG. 3 is a perspective view of one embodiment of a gaming system having the multiple player simultaneous display/input device game table of the present disclosure operating a poker game.

Referring now to FIG. 3, in an alternative embodiment, cards can be dealt in a poker game face-down. The embodiment shows a transition from game table control to player of the movement of cards. The player can move the cards by touching the cards or be using an external physical viewing device to move the cards. Further, multiple players can move their cards at the same time via either method above. Processing 12 of game system 100 or game table 10 facilitate this. The viewer 60 also illustrates use of an external physical device operable with game table 100, which modifies the game of game table 100 and also works in conjunction with features displayed by the game table.

In the poker game of FIG. 3, gaming system 10 via game table 100 deals virtual cards 64 face down to each player, which game table 100 can provide or snap to a designated position of surface of display/input device 102 in front of each player. Each player has a viewer 60, having four separate encodings 62*a* to 62*d* such as the RF encodings discussed above and in relation to the '428 patent. The encoding or tags 62*a* to 62*d* herein can be for example radio frequency tags, barcode tags, and dot coded tags.

The encodings are located at the bottom corners of viewer 60 as generally seen in FIG. 3. Gaming system 10 knows where cards 64 are located. Each player can move their cards 64, which in one embodiment travel together, e.g., two or three at a time, such that the cards 64 cannot be moved towards or away from each other. Game table 100 deals a second face-down card 64, which is provided or snaps into position next to the first face down card 64, deals the third face-down card 64 so that it is provided or snaps into position next to the first and second face-down cards 64, and so on.

Game table 100 is configured to sense when the four encodings 62*a* to 62*d* of viewer 60 are centered around or adjacent to face-down cards 64, such that viewer 60 blocks the view of cards 64 to all except the player having such cards. To this end in the illustrated embodiment, viewer 60 is tilted and narrowed as necessary to enable the player see cards 64 readily while blocking the cards 64 from the other players and nearby patrons.

Once viewer 60 is centered over the face-down cards, game table 100 reveals the cards 64 within the viewer to the player holding the cards 64. If the player moves viewer 60 while centered over the face-down cards 64, the cards move with the viewer 60. As soon as any of the encodings 62*a* to 62*d* is not sensed to be at its appropriate position, game table 100 masks or hides cards 64 (simulating turning the cards back over). Using viewer 60 and game table 100 configured as discussed above, gaming system 10 can provide any suitable type of face-down poker game, including a table poker game in which players play against each other.

The poker game of FIG. 3 highlights various capabilities or functionality of gaming system 10 and game table 100. Game table 100 controls the movement of cards 64 from the deck 66 of cards 64 to the different dealt positions in front of the players. Afterwards, control of the movement of cards 64 is relinquished to the player. Cards 64 can be moved by touching the cards or by placing viewer 60 over the cards and moving the viewer. The game table 100 enables players to move their cards 64 simultaneously via either of such methods. Multiple IR cameras within game table 100 allow multiple inputs to be made to the game table at the same time. Processing 12 within gaming system 10 or game table 100 is configured to perform multiple tasks simultaneously, e.g., enable multiple viewers/card hands to be moved simultaneously.

Keno Game Example Embodiments

In one embodiment, game table 100 of gaming system 10 displays a keno game which include a plurality of selectable indicia or numbers on game table 100. Here, the player selects at least one of the selectable indicia or numbers via an input device such as a touch screen. Gaming system 10 then displays a series of drawn numbers and determines an amount of matches, if any, between the player's selected numbers and gaming system 10's drawn numbers. The player is provided an award based on the amount of matches, if any, between the player's picked numbers and the game's drawn numbers and the total number of numbers picked by the player.

As discussed herein, game table 100 is particularly well-suited for multiple player, interactive gaming in which multiple players play at the same time against a dealer or against each other. In one embodiment, multiple players play against the same house draw. In single player keno, game table 100 can be configured to let the player touch a number to select it after which the number is highlighted somehow. With multiple players, the same number can be marked in two ways if two players select the number and so on.

Figure 4:
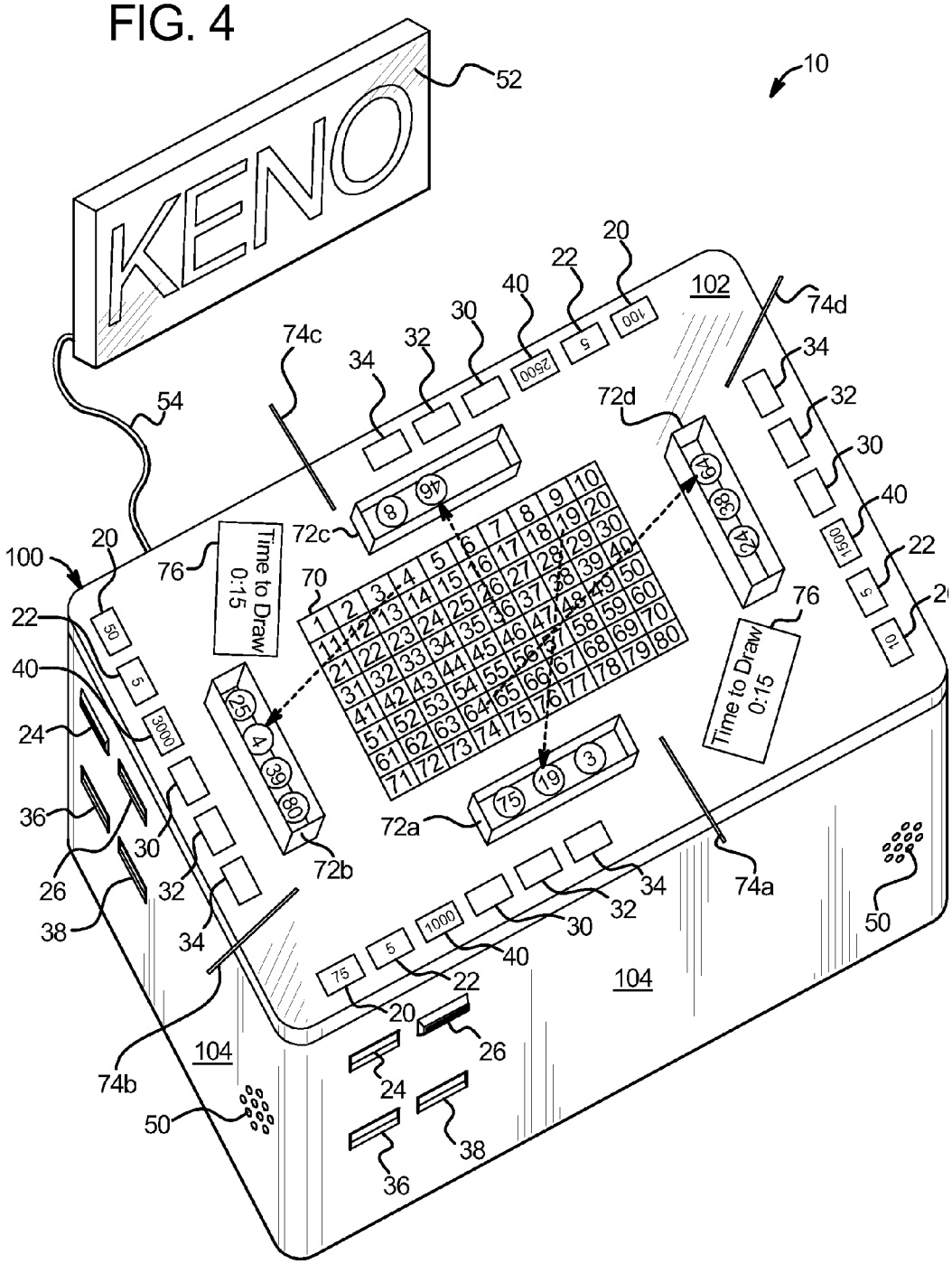
FIG. 4 is a perspective view of one embodiment of a gaming system having the multiple player simultaneous display/input device game table of the present disclosure operating a keno game.

Referring now to FIG. 4, an alternative keno game highlights various capabilities or functionality of gaming system 10. The game enables players to make keno picks simultaneously using the same surface of display/input device 102 of game table 100. In this illustrated embodiment, game table 100 enables each player to move the player's own number collection station or "basket" to a desirable area on surface of display/input device 102 near the player. Also common displays, such as time remaining until draw display 76, can be moved to any suitable position on surface of display/input device 102 desired by the players collectively. Game table 100 therefore enables game-by-game customization of the display and input of information.

In the keno game of FIG. 4, each player can grab a copy of any desired number from a virtual number array 70 and slide the number copies into the player's virtual basket 72*a* to 72*d*, leaving the original of the number at the number array 70. If the player lifts the player's hand from surface of display/input device 102 before the number copy reaches the basket, the number copy either disappears or snaps back to the original of the number at array 70. Alternatively, the number copy can sit at the position at which it has been left for a period of time or up until gaming system 10 begins to draw numbers. As that time arrives, the number copy can flash for a few seconds to prompt the player. A player can slide a number copy out of his/her basket 72*a* to 72*d*, at which time it either disappears or snaps back to the original. If a player slides the same number copy into his/her basket 72*a* to 72*d*, gaming system 10 can either ignore the later selected copy or consider it an increase in the player's wager.

Game table 100 is configured such that a player can drag a copy of a particular number over the original of another number located in number array 70 without selecting that other number. If the player's finger does not provide enough resolution given the spacing of numbers within array 70, gaming system 100 can be provided with suitable wands 74*a* to 74*d*, respectively, for each player. Each wand may have a tag or may have an encoded tip. The tag or encoded tip can be provided if for example the casino or manufacturer does not want players using non-authorized wands.

Gaming system 10 highlights its drawn numbers at array 70. Any number in the player's basket 72*a* to 72*d* that matches a number drawn by gaming system 10 is highlighted to show the player that the match has occurred. The matched numbers at the end of the draw are counted and each player is paid according to a paytable.

The keno game of FIG. 4 highlights various capabilities or functionality of gaming system 10. Here, the game can, but does not have to, be sequential. The keno game in one embodiment enables the players to independently choose when to pick desired keno numbers up until the time of the draw, shown in time displays 76. There is no set sequence, which enhances player interaction as the players crisscross each other to pick their numbers. Virtual baskets 72*a* to 72*d* can be moved to any position on surface of display/input device 102 desired by the players. Game table 100 also enables displays 76 to be moved to positions that are acceptable to the players collectively.

Bonus Game Embodiments

In various embodiments, in addition to winning credits or other awards in a base or primary game, gaming system 10 also produces players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game. The triggering of one bonus game for gaming system 10 via game play is discussed in detail below. In other embodiments, the triggering event or qualifying condition occurs based on exceeding a certain amount of game play (such as number of games, number of credits, amount of time), or reaching a specified number of points earned during game play.

In another embodiment, processing 12 of gaming system 10 or a central server 56 (see FIG. 2B discussed above) provides the player one or more plays of one or more secondary games randomly. In one such embodiment, gaming system 10 does not provide any apparent reason to the player for qualifying to play a secondary or bonus game. Here, qualifying for a bonus game is not triggered by an event in or based specifically on any of the plays of any primary game. That is, gaming system 10 may simply qualify a player to play a secondary game without any explanation or alternatively with simple explanations. In another embodiment, gaming system 10 (or central server 56) qualifies a player for a secondary game at least partially based on a game triggered or symbol triggered event, such as at least partially based on the play of a primary game.

In one embodiment, gaming system 10 includes a program which begins automatically a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player. One example of a "buy-in" discussed below is a side bet. The player must make a separate side-wager on the bonus game or wager a designated amount in the primary game to qualify for the secondary game.

Blackjack Game with Bonus Example Embodiments

Figure 5:
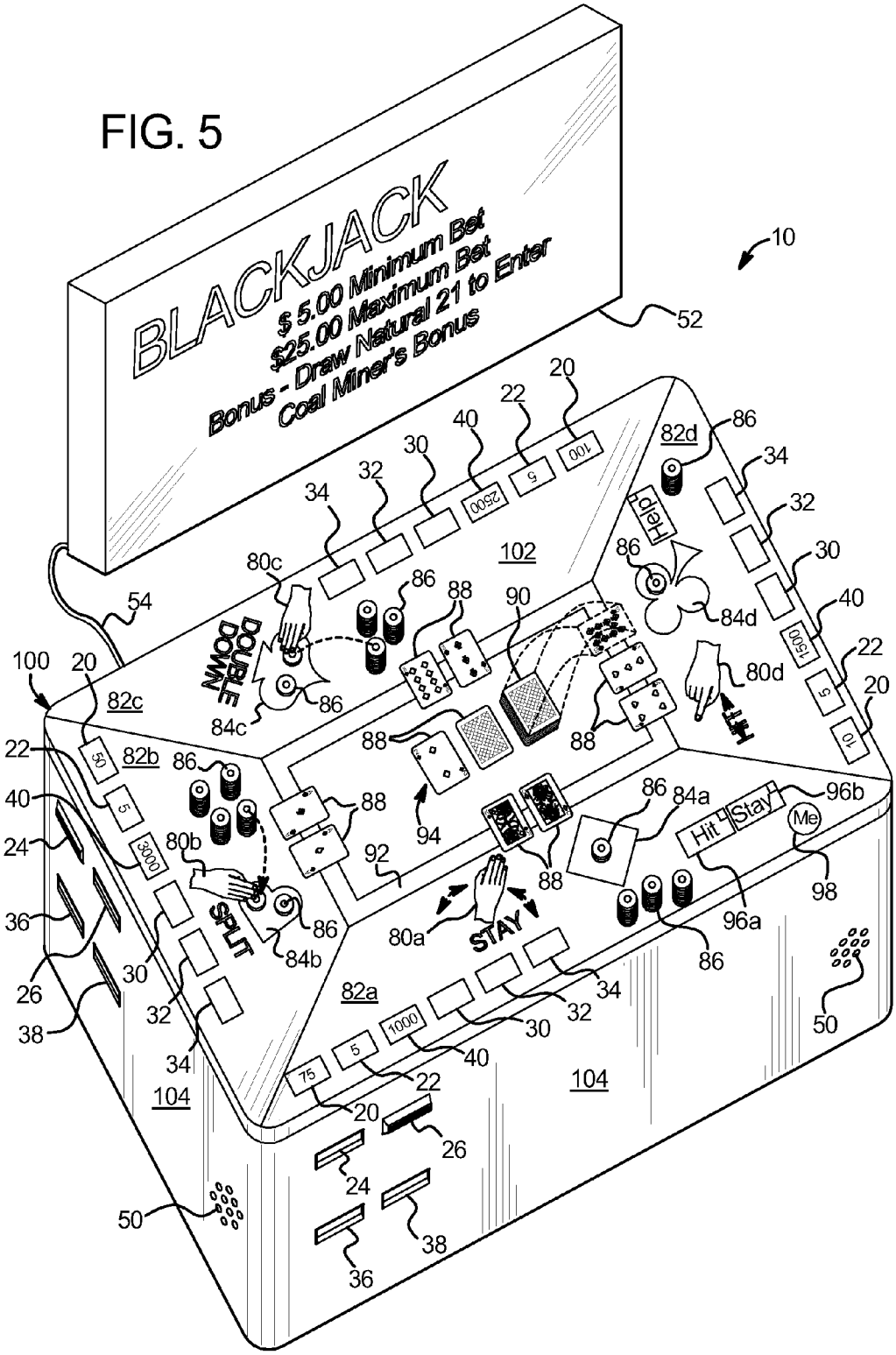
FIG. 5 is a perspective view of one embodiment of a gaming system having the multiple player simultaneous display/input device game table of the present disclosure operating a blackjack base game having a bonus game.

More specifically, one example embodiment of how the game table of the present disclosing can be additionally employed is shown by the blackjack game displayed by game table 100 illustrated in FIG. 5. The blackjack game illustrates simultaneous game play on a single display/input device of the game table 100. The blackjack game illustrates the concept of providing certain areas for each player and enabling each player to customize the area as well as being the only player allowed to input changes in their area. The blackjack game illustrates a transition from game control of the movement of game items to game control of such items. The blackjack game illustrates space optimization of surface of display/input device 102 of game table 100, including moveable displayed chips, displayed game pieces and displayed input devices that can be minimized. The displayed chips can be "handled" or moved singly or in bulk. The game displayed by game table 100 is played using many of the same methods as actual table blackjack (such as wagering additional chips to double down or split).

In the blackjack embodiment of FIG. 5, four players 80*a*, 80*b*, 80*c*, and 80*d* play the blackjack game simultaneously, each player having a corresponding quadrant 82*a*, 82*b*, 82*c*, and 82*d* of surface of display/input device 102. Player 80*a* is the diamond player and places his or her bet on moveable diamond wager placement area 84*a*. Player 80*b* is the heart player and places his or her bet on moveable heart wager placement area 84*b*. Player 80*c* is the spade player and places his or her bet on moveable spade wager placement area 84*c*. Player 80*d* is the clubs player and places his or her bet on moveable clubs wager placement area 84*d*. Each wager placement area 84*a* to 84*d* is moveable only within each player's quadrant 82*a* to 82*d* in one embodiment. Wager placement areas 84*a* to 84*d* are displayed in the illustrated embodiment.

Each player has a plurality of displayed chips 86, which are placed in stacks. For example, for a $5.00 minimum table, a player cashing in $20.00 will get a stack of four chips 86. A player cashing in $100.00 can get, for example, two stacks of 10 chips. The displayed chips appear in three-dimensions with bottom chips appearing to be under surface of display/input device 102. The three-dimensional images are customized for each player's position as illustrated, so that the images are oriented properly for the different positions at game table 100.

Game table 100 deals displayed cards 88 from displayed deck 90 onto deal rail 92. Typically, players are not supposed to touch their cards in blackjack, so the displayed cards 88 are not moveable once dealt in one embodiment. FIG. 5 illustrates a card 88 being dealt from deck 90 to player 80*d*. The display/input device slides the card off of the deck into the proper position on rail 92. As the sliding takes place or once the card reaches rail 92, the display/input device reveals the card to the player.

The display/input device also deals the dealer's displayed hand 94. A first card is dealt face-down and second card is dealt face-up adjacent to the face-down card to form the dealer hand 94 as shown. The blackjack game proceeds sequentially (such as beginning with diamond player 80*a*). Upon being dealt a king and a queen, player 80*a* decides to stay. To do so, player 80*a* moves his or her hand side-to-side above surface of display/input device 102 as illustrated, within quadrant 82*a*, which at this time is the only active quadrant. One or more IR capable cameras or readers beneath surface of display/input device 102 detects the player's hand moving side to side without the player having to actually touch surface of display/input device 102. Actions taken in other quadrants 82 (referring collectively to remaining quadrants) are ignored or not allowed in one embodiment, although in other embodiments, players can simultaneously make inputs.

The display/input device then activates quadrant 82*b* for heart player 80*b*. In one embodiment active quadrants are highlighted such as brightened and non-active quadrants are dulled. Upon being dealt a pair of aces, player 80*b* decides to split the pair. To do so, player 80*b* moves a displayed chip 86 from one of his or her piles to wager placement area 84*b* as illustrated, located within quadrant 82*b*, which at this time is the only active quadrant. In this embodiment, actions taken in other quadrants 82 (referring collectively to remaining quadrants) are ignored or not allowed.

In one embodiment, placing the player's finger directly over but not touching surface of display/input device 102 highlights the top chip and causes the top chip 86 to follow the player's finger to wager placement area 84*b*, where it is snapped into position. Touching the pile of chips 86 highlights the entire stack, which can then be moved as a stack to different parts of the player's quadrant or to the wager placement area. In one embodiment, the player can move his or her chips within the respective quadrant while it is non-active, but cannot wager the chips. Even when a quadrant is active, an invalid additional wager attempt is ignored, e.g., the displayed chips are not allowed to enter the wager placement area.

In another embodiment, touching a stack of chips once causes the top chip to be highlighted and be moveable. The number "1" can appear on the top chip. Touching a stack of chips twice in succession causes the two top chips 86 to be highlighted and be moveable. The number "2" can appear on the top chip, and so on. Once the number of taps exceeds the number of chips 86 in a stack, no chips are highlighted so that the player can undue a wager decision.

Game table 100 then activates quadrant 82*c* for spade player 80*c*. Upon being dealt a three and an eight, player 80*c* decides to double down. To do so, player 80*c* moves a displayed chip 86 from one of his or her piles to wager placement area 84*c* as illustrated, located within quadrant 82*c*, which at this time is the only active quadrant. Actions taken in other quadrants 82 (referring collectively to remaining quadrants) are ignored or not allowed.

The quadrants as illustrated provide a visual confirm message, e.g., "stay", "split", "double down" and "hit" to confirm the player's choice and to provide a hand-shake like message to the player that game table 100 understands the player's intent. In one embodiment, the player can remove a chip 86 from a wager placement area after placing the chip in the area until the player moves his or her hand off of the chip and away from the wager placement area, after which the bet is made and credit meter 20 and bet meter 22 are updated accordingly. The above mentioned "split" or "double down" confirm messages are shown as soon as the chip beings to enter the wager placement area, so that the player is made aware that game table 100 is about to accept the wager.

Game table 100 then activates quadrant 82*d* for clubs player 80*d*. Upon being dealt a four and a three, player 80*d* decides to hit. To do so, player 80*d* moves his or her hand up and down above surface of display/input device 102 as illustrated, within quadrant 82*d*, which at this time is the only active quadrant. One or more IR capable cameras or reader beneath surface of display/input device 102 detects the player's hand moving up and down without the player having to actually touch surface of display/input device 102. Actions taken in other quadrants 82 (referring collectively to remaining quadrants) are ignored or not allowed. Confirm message "hit" enable game table 100 to hand-shake with the player, letting the player know that an additional card, here a ten, is going to be dealt.

Quadrant 82*a* shows an alternative apparatus and method for the player to "hit" or "stay". Game table 100 provides a "hit" button 96*a*, which the player can press for an additional card. Game table provides a "stay" button 96*b*, which the player can press to not accept another card. "Hit" button 96*a* and "stay" button 96*b* each include a minimize symbol "–", which the player can press to cause the associated button to become minimized. It is contemplated to provide a number of options that are normally minimized to conserve surface of display/input device 102 as a bank of expand symbols "+" 96*c* (here along the playing side of deal bar 92). The player can press any of the expand symbols 96*c* to enlarge the symbol to a button and activate the function of the button. When the player no longer wishes to have the button enabled, the player pressed minimize symbol "–", after which the corresponding expand symbol "+" 96*c* appears at its designated position along the bank of symbols 96. Symbols 96 can be color coded. Maintaining consistent positioning of the symbols in the bank also enables players to become familiar with the symbols quickly.

In various embodiments, the game table provides extra functionality to each player through one or more inputs. For example, "Me" button 98 (which can also be minimized) enables the players to respectively customize the player stations 82*a* to 82*d*. For example, pressing "Me" button 98 can enable the player to change game symbols, e.g., from the heart to a favorite sports or school logo, change background color, set background, e.g., from a menu of backgrounds, change loudness of sound from speakers 50, or changes brightness. "Me" button 98 can also provide suitable information such as help to a player when deciding to hit or stay (which may be always available or only when player has lost a certain amount or has only a certain amount of credits or chips remaining, since gaming system 10 or game table 100 knows how many credits the player has). In various embodiments, such extra inputs enable multiple players to each perform extra activities while playing the primary or secondary games on the same display/input device. These extra activities can range from playing side games to using the internet. It should be appreciated that the "me" button can also enable the player to access an player account such as a player tracking account. Each player's account can store any suitable information regarding or for the player such as, but not limited to, player preferences, favorite games, and favorite table layout, configurations or colors. It should also be appreciated that in certain embodiments, the "me" button enables the player to access non-gaming concierge functions, such as placing food and/or beverage order, securing a reservation at a restaurant, or purchasing show tickets.

Figure 6:
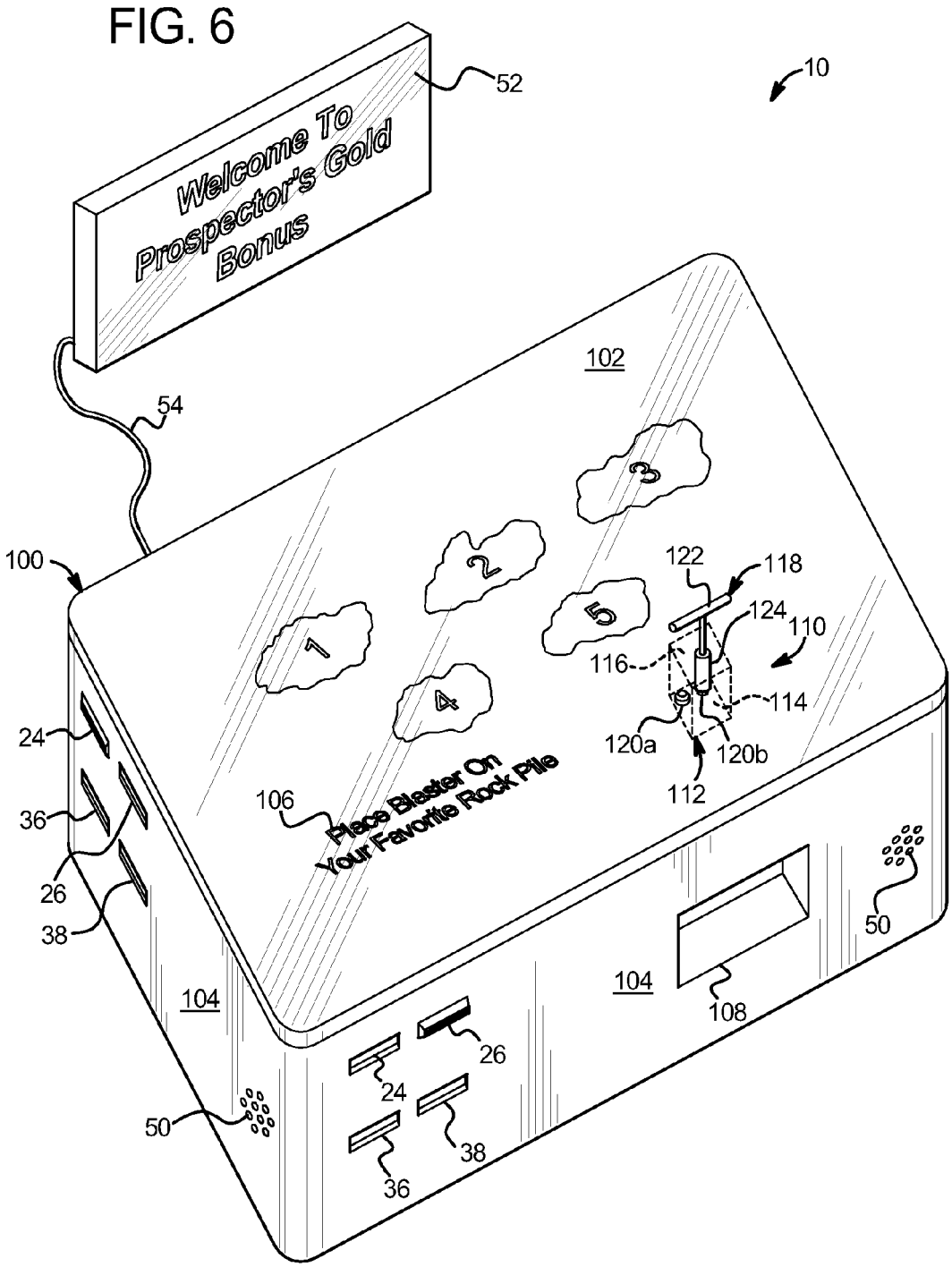
FIGS. 6, 7 and 8 are perspective views of one embodiment of a system having the multiple player simultaneous display/input device game table of the present disclosure operating a bonus game using a separate mechanical input device.
Figure 7:
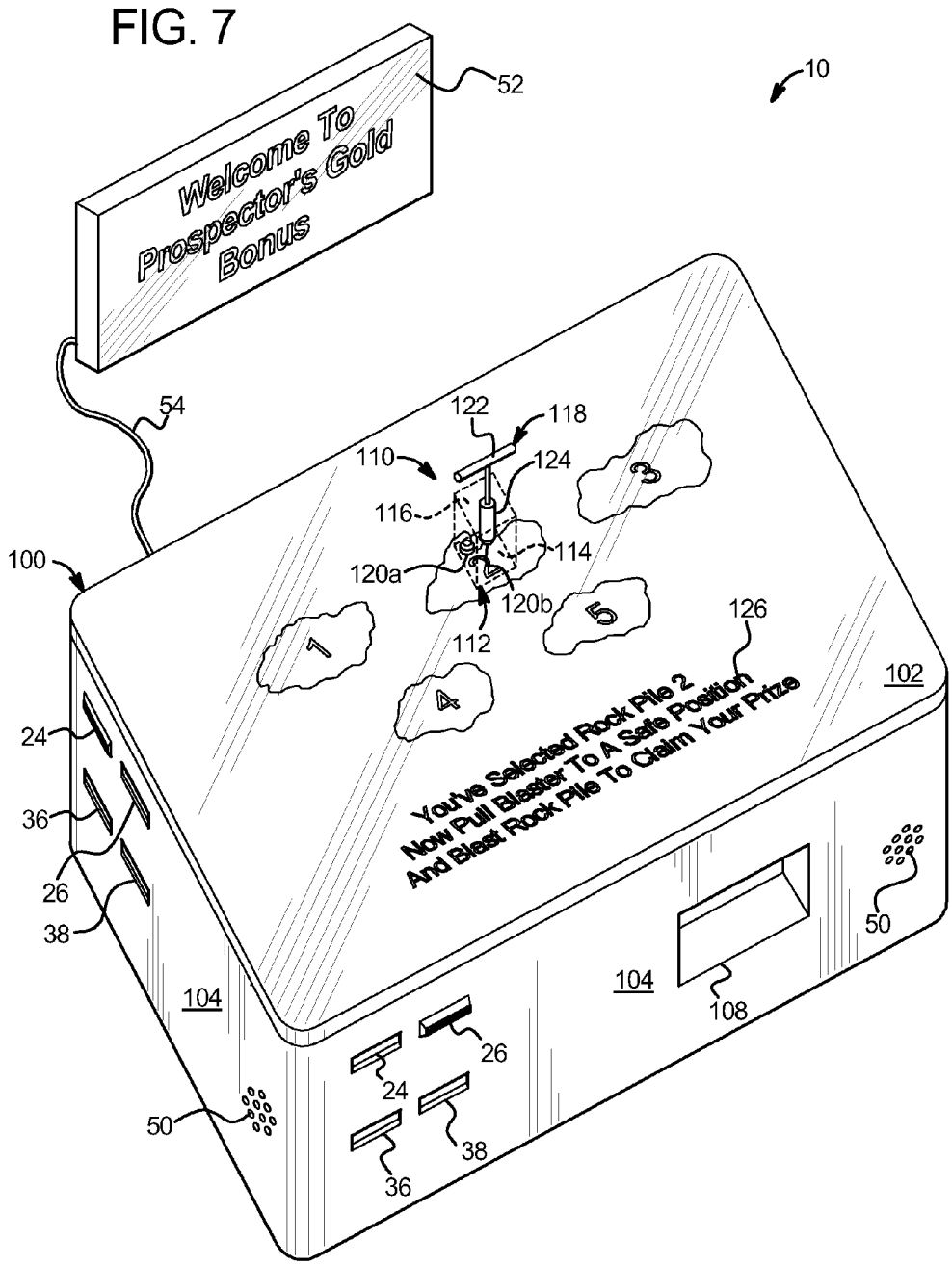
Figure 8:
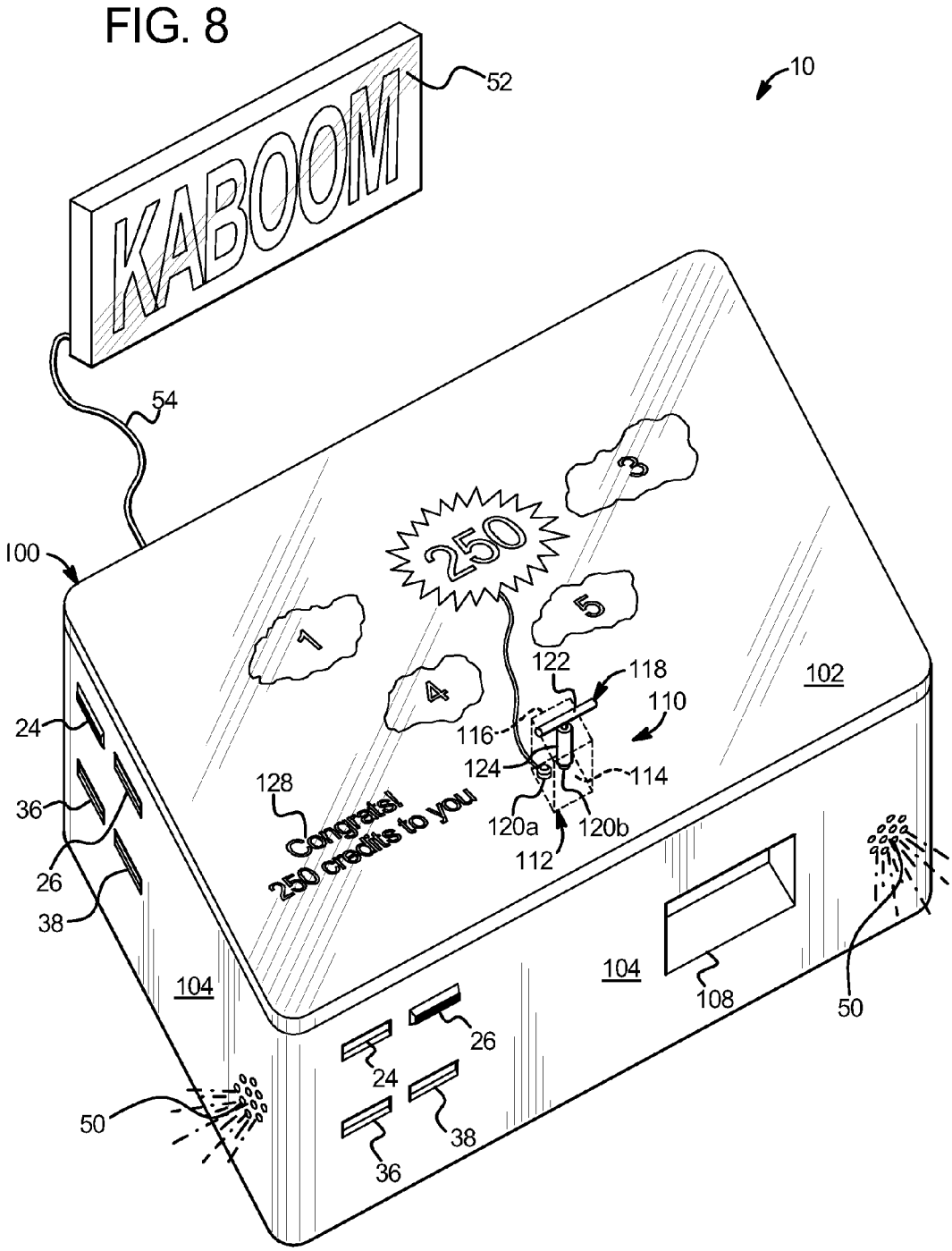

Referring now to FIGS. 6 to 8, gaming system 10 and game table 100 illustrate one embodiment of a bonus game played in combination with any primary or base game such as any of the base games disclosed above, including the blackjack game of FIG. 5. The bonus game illustrates how game table 100 can play a base game without a physical external input device and a bonus game with a physical external input device. Alternatively, it should be appreciated that the base game(s) can be played with a physical external input device. In various embodiments, the physical external input device operates with indicia displayed by game table 100. In various embodiments, the game table also performs theme enhancing and excitement producing actions, such as tracing a movement of device from one position to the next on the game table and providing graphics with the tracing that fit with the theme of the bonus game. The bonus game also shows how the tags or encodings can be used in one external physical input device for different purposes such as one to identify the external physical input device and the other to show what state the external physical input device is in.

In one example embodiment, the bonus game of FIGS. 6 to 8 is triggered when one of the players obtains a natural blackjack. Any suitable other triggering mechanisms can alternatively trigger the bonus game such as the following example Prospector's Gold example bonus selection game.

Overhead display 52 informs the players that the gaming system is now in a bonus mode. While the bonus is shown being played by one player, it could alternatively be played by multiple players. For example, multiple players could each choose a separate rock pile to explode and to reveal a prize as discussed below.

The display/input device displays an audio, visual, or audiovisual message 106 informing the player to place a blaster (described below as reveal device 110) on a desired rock pile to select that rock pile for a prize. Reveal device 110, as part of gaming system 10, in one embodiment is an external separate physical input device configured to interact wirelessly with game table 100. It should be appreciated that certain various embodiments, this external physical input device does not include any type of an electronic processor, electronic transmitter, or electronic receiver. In such embodiments, as described above, the game table and specifically the display/input device is configured to identify the passive encoded patterns of the physical input device and/or shadows cast by one or more parts of the separate physical input device. It should be appreciated that this reveal device can be suitably stored in a compartment 108 of the game table or in any other suitable manner.

Reveal device 110 in the illustrated embodiment includes a housing 112, which can be a hard plastic housing for example. Housing 112 includes a plurality of sidewalls 114, a top wall 116 and a plunger 118 connected slideably to top wall 116. Housing 112 is open at its bottom except for one or more identifier tags formed on or in a partial bottom wall of the housing. Tags 120*a* and 120*b* (in this illustrated embodiment discussed below) can be any suitable device such as radio frequency tags, barcode tags, or dot coded tags. It should be appreciated that other configurations for the housing may be employed.

Plunger 118 includes a handle 122 and a stem 124 that extends into housing 112. Stem 124 is also attached slideably to top wall 116. A second "state" encoding or tag 120*b* is located at the bottom of stem 124. Identifier tag 120*a* identifies to game table 100 which rock pile the player has chosen. State encoding or tag 120*b* tells game table 100 when the state has changed, that is, when the player has pushed plunger 118 into housing 112 to "blow-up" the rock pile.

In FIG. 7, the player places reveal device 110 on a desired rock pile, i.e., chooses a rock pile to reveal for a prize. The gaming system is programmed to look at each of rock piles 1 to 5 for identifier tag 120*a*. When the player places device 110 on one of rock piles 1 to 5, game table 100 and particularly the display/input device senses identifier tag 120*a* via an IR capable camera or reader, and confirms to the player that the player has selected a certain one of the rock piles for the player's award via an audio, visual or audiovisual message 126. In one embodiment, the gaming system is programmed such that it needs to see a continuous signal from identifier tag 120*a* for a certain period of time (such as three seconds) before sending confirm message 126. This enables the player to slide reveal device 110 over rock pile 5 to get to rock pile 2, for example, without signaling a false identification of pile 5. This is needed in case the player slides device 110 on surface of display/input device 102 instead of placing it on pile 2.

Message 126 also tells the player to pull reveal device 110 away from the selected rock pile a "safe distance" before "blowing up" the selected rock pile to reveal a prize. In FIG. 8, the player has moved reveal device 110 away from rock pile 2 a "safe distance". The cameras or readers of the display/input device beneath surface of display/input device 102 monitor the path taken by identifier tag 120*a* to the safe distance point. Game table 100 traces the monitored path with graphics on surface of display/input device 102 to form a displayed chord or cable running from the rock pile to the moved reveal device 110 at its "safe location". The chord or cable shows how the display/input device can provide functionality that enhances the theme of bonus game such as the Prospector's Gold bonus game in this example.

In FIG. 8, the player pushes plunger 118 down towards surface of display/input device 102. In this embodiment, game table 100 does not sense state tag 120*b* when plunger 118 is in the up position, but does sense tag 120*b* when the plunger is pushed down, pushing tag 120*b* to or near to surface of display/input device 102. The change of sensing states indicates to game table 100 the player's decision to "blow-up" selected rock pile 2, causing game table 100 to reveal the player's prize (which can be cash or non-monetary, such as a free show or meal). The display/input device and/or overhead display also shows a visual representation of an explosion and emits an exploding sound from speakers 50 in one embodiment. An audio, visual, or audiovisual message confirms the players award.

It should also be appreciated that in alternative embodiments, the gaming system can be configured to identify a single tag or encoded pattern to determine the location of the separate physical input device and configured to receive another type of signal for the trigger mechanism. The alternative signal can be any other suitable signal such as a Radio Frequency (RF) signal, a BLUETOOTH™ signal, a WI-FI™ signal, or an alternative light or laser signal.

Figure 9:
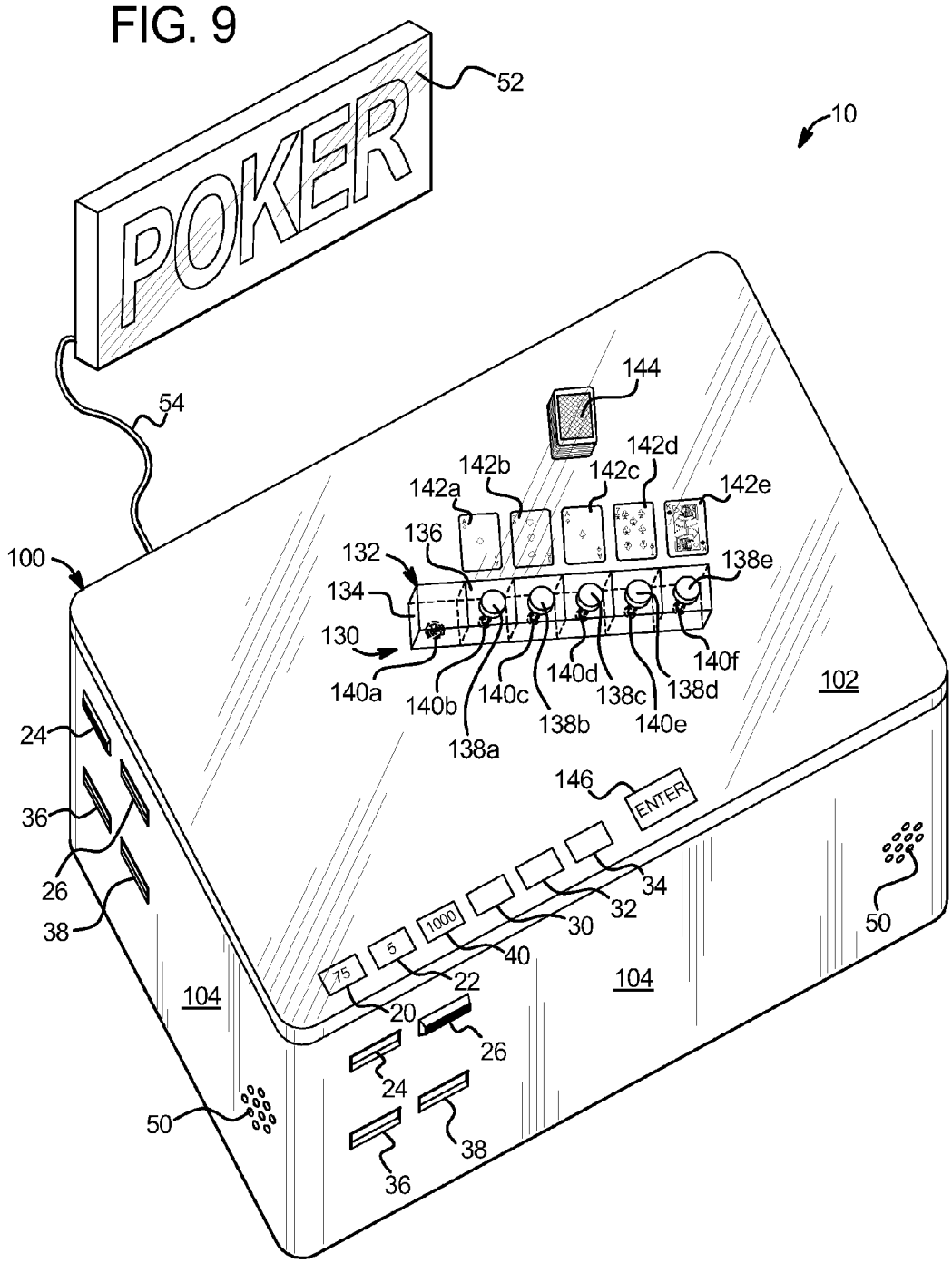
FIG. 9 is a perspective view of one embodiment of a gaming system having the multiple player simultaneous display/input device game table of the present disclosure operating a poker game using a separate mechanical input device.

Referring now to FIG. 9, game table 100 operates with a different example external physical input device 130 to play a base or video poker game as opposed to using an external physical input device for a bonus game as in the above example. Here, the external device enables the player to customize the game table for the player's size and comfort by allowing the player to place the input device on the game table at a desired position and by building (i.e., displaying) the game such as a poker game, around or adjacent to the input device placed on the surface of display/input device 102 of the game table 100. The input device 130 interacts wirelessly with game table 100 in one embodiment so that it is easy to maneuver.

Input device 130 of FIG. 9 includes a suitable housing such as housing 132 (hard plastic, having sidewalls 134 and a top 136). The bottom of housing 132 supports a first encoding or tag 140*a*, which can be printed on or embedded into the housing 132 of hold input device 130. The bottom of housing 132 also supports five spring-loaded buttons 138*a* to 138*e*, which are each connected to a stem. Additional encodings or tags 140*b* to 140*f* are located respectively on the ends of the stems. Tags 140*a* to 140*f* (discussed below) can be any suitable device such as radio frequency tags, barcode tags, or dot coded tags. The springs are biased such that game table 100 cannot sense any of tags 140*b* to 140*f* until the player presses a corresponding button 138*a* to 138*e*.

Tag 140*a* is an identifier tag. The player can slide hold input device 130 wherever the player wants to on surface of display/input device 102 of game table 100 (assuming not too close to the edges of the game table so that the cards cannot be displayed). Game table 100 senses the location of tag 140*a* and builds the poker game around or adjacent to hold input device 130, knowing the position of tag 140*a*. In one embodiment, tag 140*a* is actually two or more tags, so that gaming system 10 or game table 100 knows the orientation of tags 140*b* to 140*f* and buttons 138*a* to 138*e* relative to tag 140*a*. Alternatively, tag 140*a* can be otherwise suitably shaped (e.g., triangular) so as to provide such orientation information.

Knowing the location of tag 104*a* and the orientation of tags 140*b* to 140*f* and buttons 138*a* to 138*e* from tag 140*a*, game table 100 deals displayed cards 142*a* to 142*e* from virtual deck 144, such that cards 142*a* to 142*e* are aligned with and parallel to buttons 138*a* to 138*e*, respectively. The player presses each button 138*a* to 138*e* corresponding to any card 142*a* to 142*e* that the player wishes to keep, subject to the rules of the particular poker game being played.

When the player presses a spring-loaded button 138*a* to 138*e*, its corresponding tag 140*b* to 140*f* comes into the sensing range of game table 100. For example, if the player decides to keep the aces and king in the hand of FIG. 9, the player presses buttons 138*a*, 136*c*, and 138*e* such as in any suitable order so that tags 140*b*, 140, and 140*f*, respectively, come into the sensing range of game table 100. The gaming system is programmed to know to keep corresponding cards 142*a*, 142*c*, and 142*e* and discard the others. In one embodiment, the player presses a displayed enter button 146 to inform game table 100 that the player is done and that no further cards are to be held. The enter button 146 is alternatively a sixth button on device 130, the mechanical enter button also being spring-loaded and connected to an additional enter tag.

If the player moves device 130 after the cards have been dealt, the displayed cards move with input device 130 in one embodiment. In one embodiment, if the player moves hold input device 130 after pressing one or more of buttons 138*a* to 138*e*, the action is taken as a cancellation of the hold of the chosen card or cards and the player can start over. Such process can be repeated until the player presses virtual enter button 146 or the mechanical enter button.

In one embodiment, each of card hold tags 140*b* to 140*f* is different. Here, processing of gaming system is configured to match a particular tag 140*b* to 140*f* to a particular button 138*a* to 138*e*, respectively, and to a particular card 142*a* to 142*e*, respectively. In another embodiment, each of card hold tags 140*b* to 140*f* is the same. Processing of the gaming system is configured to sense a hold tag 140*b* to 140*f*, know or determine a position of the sensed tag from tag 140*a*, and match the particular position to a particular button 138*a* to 138*e*, respectively, and to a particular card 142*a* to 142*e*, respectively.

Figure 10:
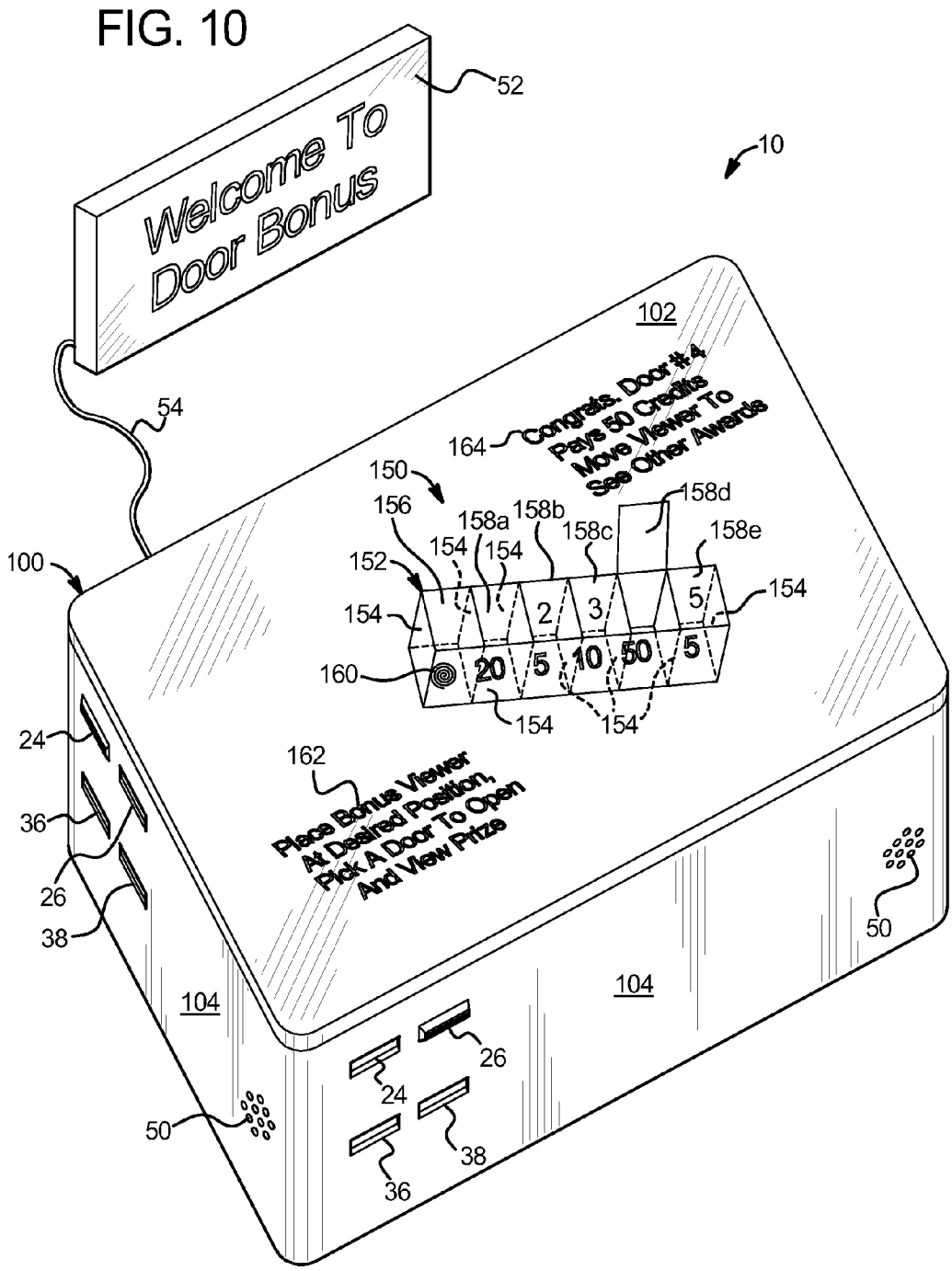
FIG. 10 is a perspective view of another embodiment of a gaming system having the multiple player simultaneous display/input device game table of the present disclosure operating a bonus game using a separate mechanical input device which does not have an electronic processor, receiver or transmitter.

Referring now to FIG. 10, game table 100 operates with another different example external input device 150 to play a bonus game. Like above with input device 130, external input device 150 enables the player to customize the display on the game table for the player's size and comfort by enabling the player to place the input device on the game table at a desired position and build the game (such as the bonus game) around or adjacent to the input device. The input device interacts wirelessly with game table 100 in one embodiment so that it is easy to maneuver in use.

Device 150 includes a suitable housing 152 having sidewalls 154 (including internal sidewalls), a partial top wall 156 and a plurality of doors 158*a* to 158*e* forming the remainder of the top surface of device 150.

A partial bottom of housing 152 supports an encoding or tag 160, which can be printed onto or embedded into the partial bottom of housing 152. Tag 160 can be any suitable device such as a radio frequency tag, a barcode tag, or a dot coded tag. The remainder of the bottom of housing 152 is open. Internal sidewalls 154 form five separate chambers within housing 152, each chamber accessible via a respective one of the doors 158*a* to 158*e*.

Tag 160 is an identifier tag. The player is enabled to slide bonus device 150 wherever the player wants to on surface of display/input device 102 of game table 100. Game table 100 senses the location of tag 160 and builds the bonus game underneath bonus device 150 knowing the position of tag 160. In one embodiment, tag 160 is actually two or more tags, so that gaming system 10 or game table 100 knows the orientation of doors 158*a* to 158*e* relative to tag 160. Alternatively, tag 160 can be suitably shaped (such as in a triangular shape) so as to provide such orientation information.

In this illustrated embodiment, the bonus game places or displays outcomes of twenty credits, five credits, ten credits, fifty credits and five credits beneath doors 158*a* to 158*e*, respectively. Each outcome accordingly has a twenty percent chance of being chosen (outcome of five credits cumulatively forty percent). With the doors closed, the player cannot see the outcomes (and the outcomes may not be displayed by the game table until the doors are opened). If game table 100 senses movement of input device 150 before one of the doors is opened, game table 100 either moves the display of the outcomes accordingly so they remain beneath device 150 or immediately removes the display of the outcomes and posts a warning alert to the player.

Audio, visual or audiovisual message 162 informs the player to place viewer 150 at a desired position and then to open one of the doors to obtain a prize. The player opens door 158*d* (each door hinged to back sidewall 154 in one embodiment), game table 100 lights or highlights the corresponding prize, and the player receives the fifty credit prize as confirmed by audio, visual or audiovisual message 164. In one embodiment, gaming system 10 or game table 100 knows that the player has selected door 158*d* because a camera or reader of the display/input device of game table 100 senses that a reflection of light within the chamber beneath door 158*d* which is present when closed is removed when it is opened. The player can thereafter move bonus input device 150 to see what other prizes were available. Bonus input device or viewer 150 therefore serves a second purpose in this embodiment, namely, performing a reveal function, which is generally desirable to satisfy player curiosity.

It should be appreciated that the external input device 150 is not limited to the game displayed in connection with FIG. 10. For example, it is contemplated to provide a multiplayer game in which players take turns opening doors 158*a* to 158*e* (and that more or less doors could be provided). Once a door is opened, it stays opened, so that further selection is more limited. A game for example could require that two particular items out of five be picked and give three players each one chance to pick the two required items. Alternatively, the sum of the three player's picks could have to beat a limit. The outcomes could alternatively be items used in a further bonus game, such that collecting more items translates into more chances in the bonus game.

In a further embodiment, the separate physical input device is in the form of a shoe (not illustrated) for use in connection with dealing cards on more appropriately in connection with the display/input device causing cards to be displayed. In this embodiment, a live dealer would use the shoe in conjunction with the display/input device to deal cards to each of the multiple players. In one embodiment, the dealer would leave the shoe in a single designated position. In another embodiment, the dealer could move the shoe to deal to each player. In various embodiments, the shoe can include one or more plungers or other mechanisms with tags that enable the dealer to cause the display/input device to deal cards to the players. In certain embodiments, the display/input device causes each card displayed by the display/input device to appear that it is coming from the shoe (which does not have physical cards in it) and to move to the appropriate player position. This provides a gaming experience which is more like a live table game, while providing the security and other advantages of a gaming system without physical cards and/or physical chips. It should be appreciated that the shoe and use of the shoe can be configured in other suitable manners.

In a further alternative embodiment, a real shoe with real physical cards can be employed with the gaming system. In certain such embodiments, the gaming system can be configured to read and identify each of the cards dealt from the shoe. Suitable marking can be used on each card to enable the gaming system to identify each card.

It should also be appreciated that one or more coded patterns can be attached or applied to any other object or personal item selected by the player or purchased by the player. For instance, a coded pattern can be attached to a player's lucky charm, personal dauber, or communication device.

It should be appreciated that the gaming system of the present disclosure enables each of one or more players to simultaneously play one or more primary games and one or more secondary games. It should further be appreciated that the gaming system enables each of the players to readily switch back and forth between such games.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a game table having a single multiplayer display/input device; and at least one processor configured to operate with the single multiplayer display/input device to:

(a) enable each of a plurality of players to simultaneously make inputs for a play of a primary wagering game using the single multiplayer display/input device, said inputs include wagers on the play of the primary wagering game, and (b) for the play of the primary wagering game: (i) cause the single multiplayer display/input device to display a plurality of randomly determined primary wagering game symbols, and (ii) after the display of the plurality of randomly determined primary wagering game symbols, cause the single multiplayer display/input device to receive a selection of at least one of said displayed randomly determined primary wagering game symbols from a separate physical input device configured to interact with the single multiplayer display/input device, said separate physical input device having a housing, a mechanical actuator supported by the housing, and a passive encoded pattern positioned on a bottom portion of the mechanical actuator, wherein the single multiplayer display/input device is configured to identify the passive encoded pattern and said mechanical actuator is moveable by at least one of the plurality of players.

2. The gaming system of claim 1, wherein the separate physical input device includes a plurality of different passive encoded patterns, and the single multiplayer display/input device is configured to identify each of the passive encoded patterns.

3. The gaming system of claim 1, wherein the single multiplayer display/input device is configured to identify the passive encoded pattern to determine a position of the separate physical input device on the game table.

4. The gaming system of claim 3, wherein the at least one processor is configured to operate with the single multiplayer display/input device to display at least a part of the play of the primary game based on the position of the separate physical input device on the game table.

5. The gaming system of claim 3, wherein the at least one processor is configured to operate with the single multiplayer display/input device to display at least a part of the play of the primary game under the separate physical input device on the game table based on the position of the separate physical input device on the game table.

6. The gaming system of claim 3, wherein the at least one processor is configured to operate with the single multiplayer display/input device to display at least a part of the play of the primary game adjacent to the separate physical input device on the game table based on the position of the separate physical input device on the game table.

7. The gaming system of claim 1, wherein the at least one processor is configured to operate with the single multiplayer display/input device to display an outcome of the play of the wagering game after identifying movement of the mechanical actuator.

8. The gaming system of claim 1, wherein the single multiplayer display/input device is configured to identify movement of the mechanical actuator by identifying a shadow cast by the mechanical actuator.

9. The gaming system of claim 1, wherein the separate physical input device includes a plurality of mechanical actuators and the single multiplayer display/input device is configured to identify movement of each of the mechanical actuators.

10. The gaming system of claim 9, wherein the at least one processor is configured to operate with the single multiplayer display/input device to select and display one of a plurality of different outcomes for the play of the primary wagering game based on an identification which of the plurality of mechanical actuators was moved by one of the players.

11. A gaming system comprising:

a game table having a single multiplayer display/input device; and at least one processor configured to operate with the single multiplayer display/input device to:

(a) enable each of a plurality of players to simultaneously make inputs for a play of a primary wagering game using the single multiplayer display/input device, said inputs include wagers on the play of the primary wagering game, and (b) for a play of a secondary game: (i) cause the single multiplayer display/input device to display a plurality of secondary game symbols, said displayed secondary game symbols have a plurality of different awards associated with said symbols, (ii) after the display of the plurality of secondary game symbols, cause the single multiplayer display/input device to receive a selection of at least one of said displayed secondary game symbols from a separate physical input device configured to interact with the single multiplayer display/input device, said separate physical input device having a housing, a mechanical actuator supported by the housing, and a passive encoded pattern positioned on a bottom portion of the mechanical actuator, wherein the single multiplayer display/input device is configured to identify the passive encoded pattern to determine a position of the separate physical input device on the game table and said mechanical actuator is moveable by at least one of the plurality of players, and (iii) cause the single multiplayer display/input device to display at least a part of the play of the secondary game under the separate physical input device on the game table based on the position of the separate physical input device on the game table.

12. The gaming system of claim 11, wherein the separate physical input device includes a plurality of different passive encoded patterns, and the single multiplayer display/input device is configured to identify each of the passive encoded patterns.

13. The gaming system of claim 11, wherein the at least one processor is configured to operate with the single multiplayer display/input device to display at least a part of the play of the secondary game adjacent to the separate physical input device on the game table based on the position of the separate physical input device on the game table.

14. The gaming system of claim 11, wherein the at least one processor is configured to operate with the single multiplayer display/input device to display an outcome of the play of the secondary game after identifying movement of the mechanical actuator.

15. The gaming system of claim 11, wherein the single multiplayer display/input device is configured to identify movement of the mechanical actuator by identifying a shadow cast by the mechanical actuator.

16. The gaming system of claim 11, wherein the separate physical input device includes a plurality of mechanical actuators and the single multiplayer display/input device is configured to identify movement of each of the mechanical actuators.

17. The gaming system of claim 16, wherein the at least one processor is configured to operate with the single multiplayer display/input device to select and display one of a plurality of different outcomes for the play of the secondary game based on an identification which of the plurality of mechanical actuators was moved by one of the players.

18. A gaming system comprising:

a game table having a single multiplayer display/input device; and at least one processor configured to operate with the single multiplayer display/input device to enable at least one of the plurality of players to:

(a) simultaneously enable each a plurality of players to simultaneously make inputs for separate plays of primary wagering games using the single multiplayer display/input device, said inputs including wagers on the plays of the separate primary wagering games, and (b) for a play of a common secondary game: (i) cause the single multiplayer display/input device to display a plurality of secondary game symbols, said displayed secondary game symbols have a plurality of different awards associated with said symbols, (ii) after the display of the plurality of secondary game symbols, cause the single multiplayer display/input device to receive a selection of at least one of said displayed secondary game symbols from a separate physical input device configured to interact with the single multiplayer display/input device, said separate physical input device having a housing, a mechanical actuator supported by the housing, and a passive encoded pattern positioned on a bottom portion of the mechanical actuator, wherein the single multiplayer display/input device is configured to identify the passive encoded pattern to determine a position of the separate physical input device on the game table and said mechanical actuator is moveable by at least one of the plurality of players, and (iii) cause the single multiplayer display/input device to display part of the play of the secondary game under the separate physical input device on the game table based on the position of the separate physical input device on the game table.

19. The gaming system of claim 18, wherein the separate physical input device includes a plurality of different passive encoded patterns, and the single multiplayer display/input device is configured to identify each of the passive encoded patterns.

20. The gaming system of claim 18, wherein the at least one processor is configured to operate with the multiplayer display/input device to display at least a part of the play of the secondary game based on the position of the separate physical input device on the game table.

21. The gaming system of claim 18, wherein the at least one processor is configured to operate with the single multiplayer display/input device to display part of the play of the secondary game adjacent to the separate physical input device on the game table based on the position of the separate physical input device on the game table.

22. The gaming system of claim 18, wherein the at least one processor is configured to operate with the single multiplayer display/input device to display an outcome of the play of the secondary game after identifying movement of the mechanical actuator.

23. The gaming system of claim 18, wherein the single multiplayer display/input device is configured to identify movement of the mechanical actuator by identifying a shadow cast by the mechanical actuator.

24. The gaming system of claim 18, wherein the separate physical input device includes a plurality of mechanical actuators, wherein the single multiplayer display/input device is configured to identify movement of each of the mechanical actuators.

25. The gaming system of claim 24, wherein the single multiplayer display/input device is configured to, for each mechanical actuator, identify movement of said mechanical actuator by identifying a shadow cast by said mechanical actuator.

26. The gaming system of claim 24, wherein the at least one processor is configured to operate with the single multiplayer display/input device to select and display one of a plurality of different outcomes for the play of the secondary game based on an identification which of the plurality of mechanical actuator was moved by one of the players.

27. A gaming system comprising:

a game table having a single multiplayer display/input device; and at least one processor configured to operate with the single multiplayer display/input device to:

(a) enable each of a plurality of players to simultaneously make inputs for a play of a primary wagering game using the single multiplayer display/input device, said inputs include wagers on the play of the primary wagering game, and (b) for a play of a secondary game: (i) cause the single multiplayer display/input device to display a plurality of secondary game symbols, said displayed secondary game symbols have a plurality of different awards associated with said symbols, (ii) after the display of the plurality of secondary game symbols, cause the single multiplayer display/input device to receive a selection of at least one of said displayed secondary game symbols from a separate physical input device configured to interact with the single multiplayer display/input device, said separate physical input device having a housing, a mechanical actuator supported by the housing, and a passive encoded pattern positioned on a bottom portion of the mechanical actuator, wherein the single multiplayer display/input device is configured to identify the passive encoded pattern to determine a position of the separate physical input device on the game table and said mechanical actuator is moveable by at least one of the plurality of players, and (iii) cause the single multiplayer display/input device to display to display at least a part of the play of the secondary game adjacent to the separate physical input device on the game table based on the position of the separate physical input device on the game table.

28. The gaming system of claim 27, wherein the separate physical input device includes a plurality of different passive encoded patterns, and the single multiplayer display/input device is configured to identify each of the passive encoded patterns.

29. The gaming system of claim 27, wherein the at least one processor is configured to operate with the single multiplayer display/input device to display an outcome of the play of the secondary game after identifying movement of the mechanical actuator.

30. The gaming system of claim 27, wherein the single multiplayer display/input device is configured to identify movement of the mechanical actuator by identifying a shadow cast by the mechanical actuator.

31. The gaming system of claim 27, wherein the separate physical input device includes a plurality of mechanical actuators and the single multiplayer display/input device is configured to identify movement of each of the mechanical actuators.

32. The gaming system of claim 27, wherein the at least one processor is configured to operate with the single multiplayer display/input device to select and display one of a plurality of different outcomes for the play of the secondary game based on an identification which of a plurality of mechanical actuators was moved by one of the players.

33. A gaming system comprising:

a game table having a single multiplayer display/input device; and at least one processor configured to operate with the single multiplayer display/input device to:

(a) enable each of a plurality of players to simultaneously make inputs for a play of a primary wagering game using the single multiplayer display/input device, said inputs include wagers on the play of the primary wagering game, and (b) for a play of a secondary game: (i) cause the single multiplayer display/input device to display a plurality of secondary game symbols, said displayed secondary game symbols have a plurality of different awards associated with said symbols, (ii) after the display of the plurality of secondary game symbols, cause the single multiplayer display/input device to receive a selection of at least one of said displayed secondary game symbols from a separate physical input device configured to interact with the single multiplayer display/input device, said separate physical input device having a housing, a mechanical actuator supported by the housing, and a passive encoded pattern positioned on a bottom portion of the mechanical actuator, wherein the single multiplayer display/input device is configured to identify the passive encoded pattern and said mechanical actuator is moveable by at least one of the plurality of players, and (iii) wherein the single multiplayer display/input device is configured to identify movement of the mechanical actuator by identifying a shadow cast by the mechanical actuator.

34. The gaming system of claim 33, wherein the separate physical input device includes a plurality of different passive encoded patterns, and the single multiplayer display/input device is configured to identify each of the passive encoded patterns.

35. The gaming system of claim 33, wherein the single multiplayer display/input device is configured to identify the passive encoded pattern to determine a position of the separate physical input device on the game table.

36. The gaming system of claim 35, wherein the at least one processor is configured to operate with the single multiplayer display/input device to display at least a part of the play of the secondary game based on the position of the separate physical input device on the game table.

37. The gaming system of claim 35, wherein the at least one processor is configured to operate with the single multiplayer display/input device to display at least a part of the play of the secondary game under the separate physical input device on the game table based on the position of the separate physical input device on the game table.

38. The gaming system of claim 35, wherein the at least one processor is configured to operate with the single multiplayer display/input device to display at least a part of the play of the secondary game adjacent to the separate physical input device on the game table based on the position of the separate physical input device on the game table.

39. The gaming system of claim 33, wherein the at least one processor is configured to operate with the single multiplayer display/input device to display an outcome of the play of the secondary game after identifying movement of the mechanical actuator.

40. The gaming system of claim 33, wherein the separate physical input device includes a plurality of mechanical actuators and the single multiplayer display/input device is configured to identify movement of each of the mechanical actuators.

41. The gaming system of claim 40, wherein the at least one processor is configured to operate with the single multiplayer display/input device to select and display one of a plurality of different outcomes for the play of the secondary game based on an identification which of the plurality of mechanical actuators was moved by one of the players.

42. A gaming system comprising:

a game table having a single multiplayer display/input device; and at least one processor configured to operate with the single multiplayer display/input device to:

(a) enable each of a plurality of players to simultaneously make inputs for a play of a primary wagering game using the single multiplayer display/input device, said inputs include wagers on the play of the primary wagering game, and (b) for a play of a secondary game: (i) cause the single multiplayer display/input device to display a plurality of secondary game symbols, said displayed secondary game symbols have a plurality of different awards associated with said symbols, and (ii) after the display of the plurality of secondary game symbols, cause the single multiplayer display/input device to receive a selection of at least one of said displayed secondary game symbols from a separate physical input device configured to interact with the single multiplayer display/input device, said separate physical input device having a housing, a plurality of mechanical actuators supported by the housing, and a plurality of passive encoded patterns respectively positioned on a bottom portion of each of the mechanical actuators, wherein the single multiplayer display/input device is configured to identify the passive encoded patterns and said mechanical actuators are moveable by at least one of the plurality of players, wherein the single multiplayer display/input device is configured to identify movement of each of the mechanical actuators.

43. The gaming system of claim 42, wherein the at least one processor is configured to operate with the single multiplayer display/input device to display at least a part of the play of the secondary game based on the position of the separate physical input device on the game table.

44. The gaming system of claim 42, wherein the at least one processor is configured to operate with the single multiplayer display/input device to display at least a part of the play of the secondary game under the separate physical input device on the game table based on the position of the separate physical input device on the game table.

45. The gaming system of claim 42, wherein the at least one processor is configured to operate with the single multiplayer display/input device to display at least a part of the play of the secondary game adjacent to the separate physical input device on the game table based on the position of the separate physical input device on the game table.

46. The gaming system of claim 42, wherein the at least one processor is configured to operate with the single multiplayer display/input device to display an outcome of the play of the secondary game after identifying movement of the mechanical actuators.

47. The gaming system of claim 42, wherein the at least one processor is configured to operate with the single multiplayer display/input device to select and display one of a plurality of different outcomes for the play of the secondary game based on an identification which of the plurality of mechanical actuators was moved by one of the players.

48. A gaming system comprising:

a game table having a single multiplayer display/input device; and at least one processor configured to operate with the single multiplayer display/input device to enable at least one of the plurality of players to:

(a) simultaneously enable each a plurality of players to simultaneously make inputs for separate plays of primary wagering games using the single multiplayer display/input device, said inputs including wagers on the plays of the separate primary wagering games, and (b) for a play of a common secondary game: (i) cause the single multiplayer display/input device to display a plurality of secondary game symbols, said displayed secondary game symbols have a plurality of different awards associated with said symbols, (ii) after the display of the plurality of secondary game symbols, cause the single multiplayer display/input device to receive a selection of at least one of said displayed secondary game symbols from a separate physical input device configured to interact with the single multiplayer display/input device, said separate physical input device having a housing, a mechanical actuator supported by the housing, and a passive encoded pattern positioned on a bottom portion of the mechanical actuator, wherein the single multiplayer display/input device is configured to identify the passive encoded pattern to determine a position of the separate physical input device on the game table and said mechanical actuator is moveable by at least one of the plurality of players, and (iii) cause the single multiplayer display/input device to display part of the play of the secondary game adjacent to the separate physical input device on the game table based on the position of the separate physical input device on the game table.

49. The gaming system of claim 48, wherein the separate physical input device includes a plurality of different passive encoded patterns, and the single multiplayer display/input device is configured to identify each of the passive encoded patterns.

50. The gaming system of claim 48, wherein the at least one processor is configured to operate with the single multiplayer display/input device to display an outcome of the play of the secondary game after identifying movement of the mechanical actuator.

51. The gaming system of claim 48, wherein the single multiplayer display/input device is configured to identify movement of the mechanical actuator by identifying a shadow cast by the mechanical actuator.

52. The gaming system of claim 48, wherein the separate physical input device includes a plurality of mechanical actuators, wherein the single multiplayer display/input device is configured to identify movement of each of the mechanical actuators.

53. The gaming system of claim 52, wherein the single multiplayer display/input device is configured to, for each mechanical actuator, identify movement of said mechanical actuator by identifying a shadow cast by said mechanical actuator.

54. The gaming system of claim 48, wherein the at least one processor is configured to operate with the single multiplayer display/input device to select and display one of a plurality of different outcomes for the play of the secondary game based on an identification which of the plurality of mechanical actuator was moved by one of the players.

55. A gaming system comprising:

a game table having a single multiplayer display/input device; and at least one processor configured to operate with the single multiplayer display/input device to enable at least one of the plurality of players to (a) simultaneously enable each a plurality of players to simultaneously make inputs for separate plays of primary wagering games using the single multiplayer display/input device, said inputs including wagers on the plays of the separate primary wagering games, and (b) for a play of a common secondary game: (i) cause the single multiplayer display/input device to display a plurality of secondary game symbols, said displayed secondary game symbols have a plurality of different awards associated with said symbols, and (ii) after the display of the plurality of secondary game symbols, cause the single multiplayer display/input device to receive a selection of at least one of said displayed secondary game symbols from a separate physical input device configured to interact with the single multiplayer display/input device, said separate physical input device having a housing, a mechanical actuator supported by the housing, and a passive encoded pattern positioned on a bottom portion of the mechanical actuator, wherein the single multiplayer display/input device is configured to identify the passive encoded pattern and said mechanical actuator is moveable by at least one of the plurality of players, wherein the single multiplayer display/input device is configured to identify movement of the mechanical actuator by identifying a shadow cast by the mechanical actuator.

56. The gaming system of claim 55, wherein the at least one processor is configured to operate with the multiplayer display/input device to display at least a part of the play of the secondary game based on the position of the separate physical input device on the game table.

57. The gaming system of claim 55, wherein the at least one processor is configured to operate with the single multiplayer display/input device to display an outcome of the play of the secondary game after identifying movement of the mechanical actuator.

58. A gaming system comprising:

a game table having a single multiplayer display/input device; and at least one processor configured to operate with the single multiplayer display/input device to enable at least one of the plurality of players to (a) simultaneously enable each a plurality of players to simultaneously make inputs for separate plays of primary wagering games using the single multiplayer display/input device, said inputs including wagers on the plays of the separate primary wagering games, and (b) for a play of a common secondary game: (i) cause the single multiplayer display/input device to display a plurality of secondary game symbols, said displayed secondary game symbols have a plurality of different awards associated with said symbols, and (ii) after the display of the plurality of secondary game symbols, cause the single multiplayer display/input device to receive a selection of at least one of said displayed secondary game symbols from a separate physical input device configured to interact with the single multiplayer display/input device, said separate physical input device having a housing, a plurality of mechanical actuators supported by the housing, and a plurality of passive encoded patterns respectively positioned on a bottom portion of each of the mechanical actuator, wherein the single multiplayer display/input device is configured to identify the passive encoded patterns and movement of each of the mechanical actuators, wherein said mechanical actuators are moveable by at least one of the plurality of players.

59. The gaming system of claim 58, wherein the at least one processor is configured to operate with the multiplayer display/input device to display at least a part of the play of the secondary game based on the position of the separate physical input device on the game table.

60. The gaming system of claim 58, wherein the at least one processor is configured to operate with the single multiplayer display/input device to display part of the play of the secondary game under the separate physical input device on the game table based on the position of the separate physical input device on the game table.

61. The gaming system of claim 58, wherein the at least one processor is configured to operate with the single multiplayer display/input device to display part of the play of the secondary game adjacent to the separate physical input device on the game table based on the position of the separate physical input device on the game table.

62. The gaming system of claim 58, wherein the at least one processor is configured to operate with the single multiplayer display/input device to display an outcome of the play of the secondary game after identifying movement of the mechanical actuators.

63. The gaming system of claim 58, wherein the at least one processor is configured to operate with the single multiplayer display/input device to select and display one of a plurality of different outcomes for the play of the secondary game based on an identification which of the plurality of mechanical actuator was moved by one of the players.

* * * * *

UNITED STATES PATENT AND TRADEMARK OFFICE

CERTIFICATE OF CORRECTION

PATENT NO. : 8,439,756 B2
APPLICATION NO. : 12/267120
DATED : May 14, 2013
INVENTOR(S) : Anthony J. Baerlocher et al.

It is certified that error appears in the above-identified patent and that said Letters Patent is hereby corrected as shown below:

IN THE CLAIMS

In Claim 1, Column 32, Line 10, replace “include” with --including--.
In Claim 10, Column 33, Line 8, between “identification” and “which” insert --of--.
In Claim 11, Column 33, Line 19, replace “include” with --including--.
In Claim 11, Column 33, Line 24, replace “have” with --having--.
In Claim 13, Column 33, Line 53, replace “a” with --another--.
In Claim 17, Column 34, Line 8, between “identification” and “which” insert --of--.
In Claim 18, Column 34, Line 16, replace “the” with --a--.
In Claim 18, Column 34, Line 17, replace “a” with --of the--.
In Claim 18, Column 34, Line 25, replace “have” with --having--.
In Claim 18, Column 34, Line 41, between “display” and “part” insert --a--.
In Claim 20, Column 34, Line 51, between “the” and “multiplayer” insert --single--.
In Claim 20, Column 34, Line 52, replace “a” with --another--.
In Claim 21, Column 34, Line 57, between “display” and “part” insert --another--.
In Claim 26, Column 35, Line 17, between “identification” and “which” insert --of--.
In Claim 26, Column 35, Line 18, replace “actuator” with --actuators--.
In Claim 27, Column 35, Line 27, replace “include” with --including--.
In Claim 27, Column 35, Line 32, replace “have” with --having--.
In Claim 32, Column 36, Line 10, between “identification” and “which” insert --of--.
In Claim 33, Column 36, Line 21, replace “include” with --including--.
In Claim 33, Column 36, Line 26, replace “have” with --having--.
In Claim 33, Column 36, Line 27, between “symbols,” and “(ii)” insert --and--.
In Claim 33, Column 36, Line 40, delete “and (iii)”.
In Claim 41, Column 37, Line 18, between “identification” and “which” insert --of--.
In Claim 42, Column 37, Line 28, replace “include” with --including--.
In Claim 42, Column 37, Line 33, replace “have” with --having--.
In Claim 43, Column 37, Line 54, replace the first instance of “the” with --a--.
In Claim 44, Column 37, Line 60, replace the second instance of “the” with --a--.

Signed and Sealed this
Tenth Day of December, 2013

Margaret A. Focarino

Margaret A. Focarino
*Commissioner for Patents of the United States Patent and Trademark Office*

In Claim 45, Column 37, Line 66, replace the second instance of “the” with --a--.
In Claim 48, Column 38, Line 18, replace “the” with --a--.
In Claim 48, Column 38, Line 19, replace “a” with --of the--.
In Claim 48, Column 38, Line 27, replace “have” with --having--.
In Claim 48, Column 38, Line 44, between “display” and “part” insert --a--.
In Claim 54, Column 39, Line 6, replace “48” with --52--.
In Claim 54, Column 39, Line 10, between “identification” and “which” insert --of--.
In Claim 54, Column 39, Line 11, replace “actuator” with --actuators--.
In Claim 55, Column 39, Line 18, replace “the” with --a-- and after “to” insert --:--.
In Claim 55, Column 39, Line 19, replace “a” with --of the--.
In Claim 55, Column 39, Line 27, replace “have” with --having--.
In Claim 56, Column 39, Line 46, between “the” and “multiplayer” insert --single--.
In Claim 56, Column 39, Line 48, replace the first instance of “the” with --a--.
In Claim 58, Column 40, Line 3, replace “the” with --a-- and after “to” insert --:--.
In Claim 58, Column 40, Line 4, replace “a” with --of the--.
In Claim 58, Column 40, Line 12, replace “have” with --having--.
In Claim 58, Column 40, Line 22, replace “actuator” with --actuators--.
In Claim 59, Column 40, Line 31, replace the first instance of “the” with --a--.
In Claim 60, Column 40, Line 35, between “display” and “part” insert --a--.
In Claim 60, Column 40, Line 37, replace the first instance of “the” with --a--.
In Claim 61, Column 40, Line 41, between “display” and “part” insert --a--.
In Claim 61, Column 40, Line 43, replace the first instance of “the” with --a--.
In Claim 63, Column 40, Line 54, between “identification” and “which” insert --of--.
In Claim 63, Column 40, Line 55, replace “actuator” with --actuators--.